US007467662B2

(12) United States Patent
Smith

(10) Patent No.: US 7,467,662 B2
(45) Date of Patent: Dec. 23, 2008

(54) METHOD AND APPARATUS FOR INSTALLING AN UNDERSEA UMBILICAL

(75) Inventor: Ron Smith, Seabrook, TX (US)

(73) Assignee: Deep Down, Inc., Channelview, TX (US)

( * ) Notice: Subject to any disclaimer, the term of this patent is extended or adjusted under 35 U.S.C. 154(b) by 164 days.

(21) Appl. No.: 10/889,413

(22) Filed: Jul. 12, 2004

(65) Prior Publication Data

US 2006/0005971 A1 Jan. 12, 2006

(51) Int. Cl.
*E21B 29/12* (2006.01)

(52) U.S. Cl. ..... 166/343; 166/344; 405/170

(58) Field of Classification Search ..... 166/338–345
See application file for complete search history.

(56) References Cited

U.S. PATENT DOCUMENTS 3,459,442 A * 8/1969 Johnson et al. ..... 285/27
4,019,334 A * 4/1977 Sinclair et al. ..... 405/169
4,102,146 A * 7/1978 Dietrich ..... 405/169
4,161,367 A * 7/1979 Cuiper et al. ..... 405/169
4,188,050 A * 2/1980 Lochte ..... 285/24
4,436,449 A * 3/1984 Smoot et al. ..... 405/170
4,457,378 A * 7/1984 Watkins ..... 166/347
4,580,636 A * 4/1986 Johnson et al. ..... 166/343
4,604,961 A * 8/1986 Ortloff et al. ..... 114/230.12
4,620,818 A * 11/1986 Langner ..... 405/169
4,717,287 A * 1/1988 Laursen ..... 405/169
4,730,677 A * 3/1988 Pearce et al. ..... 166/345
4,784,523 A * 11/1988 Louis et al. ..... 405/169
4,859,117 A * 8/1989 Brandi et al. ..... 405/224
4,877,356 A * 10/1989 Bontenbal ..... 405/169
5,067,429 A * 11/1991 Castel ..... 114/230.26
5,163,783 A * 11/1992 Fahrmeier et al. ..... 405/195.1
5,494,110 A * 2/1996 Appleford ..... 166/339
5,593,249 A * 1/1997 Cox et al. ..... 405/191
5,807,027 A * 9/1998 Ostergaard ..... 405/170
5,947,642 A * 9/1999 Teixeira et al. ..... 405/195.1
6,024,514 A * 2/2000 Ostergaard ..... 405/170
6,234,717 B1 * 5/2001 Corbetta ..... 405/170
6,742,963 B2 * 6/2004 Bekkevold et al. ..... 405/170
6,907,932 B2 * 6/2005 Reimert ..... 166/341
6,997,645 B2 * 2/2006 von Trepka et al. ..... 405/170
7,086,807 B2 * 8/2006 Mackinnon ..... 405/170
2006/0180313 A1 * 8/2006 Reynolds ..... 166/341

* cited by examiner

*Primary Examiner*—Thomas A Beach
(74) *Attorney, Agent, or Firm*—Husch Blackwell Sanders LLP

(57) ABSTRACT

An installation apparatus comprises a coupling member, a guide member, and a securing member operable to secure a termination system to the coupling member.

2 Claims, 30 Drawing Sheets

METHOD AND APPARATUS FOR INSTALLING AN UNDERSEA UMBILICAL

CROSS REFERENCE TO RELATED APPLICATIONS

This application is related to U.S. patent application Ser. No. 10/889,192, filed on Jul. 12, 2004, the disclosure of which is incorporated herein by reference.

BACKGROUND

The disclosures herein relate generally to undersea wells and more particularly to a method and apparatus for installing an undersea umbilical.

Traditional installation of an undersea umbilical involves a J-plate on the termination end of the umbilical which includes center locking mechanisms such as drive screws, collet connectors, or tri-locks, located on the J-plate. These locking mechanisms are expensive, complicated, and use up space on the termination that can be better utilized.

Accordingly, it would be desirable to provide a method and apparatus for installing an undersea umbilical absent the disadvantages found in the prior methods discussed above.

SUMMARY

According to one aspect of the present invention, an installation apparatus is provided that includes a guide member defining a channel, at least one base coupled to the guide member, a guide arm moveably coupled to the at least one base, and an engagement member coupled to the guide arm.

According to another aspect of the present invention, an installation apparatus is provided that includes a coupling member comprising at least one connector, at least one receiving member coupled to the coupling member, at least one securing support coupled to the coupling member, and a securing member operable to couple to the coupling member.

According to another aspect of the present invention, an installation apparatus is provided that includes a coupling member comprising at least one receiving member, a guide member comprising at least one guide arm, the at least one guide arm operable to be received by the at least one receiving member, and at least one securing member operable to couple to the coupling member and secure a device to the coupling member.

According to another aspect of the present invention, a method for installing an undersea umbilical is provided that includes providing a terminating end on the umbilical, providing a connector operable to couple to the terminating end, guiding the terminating end to the connector, aligning the terminating end to connect to the connector, connecting the terminating end to the connector, and securing the terminating end to the connector.

According to another aspect of the present invention, an undersea umbilical is provided that includes a terminating end coupled to the umbilical, a coupling member comprising at least one receiving member and at least one connector, the at least one connector coupled with the terminating end, at least one securing support coupled to the coupling member, and a securing member coupled to the coupling member and securing the terminating end to the at least one connector.

According to another aspect of the present invention, an apparatus is provided that includes an off shore structure, an umbilical coupled to the structure, the umbilical comprising a terminating end, a coupling member comprising at least one receiving member and at least one connector, the at least one connector coupled with the terminating end, at least one securing support coupled to the coupling member, and a securing member coupled to the coupling member and securing the terminating end to the at least one connector.

According to another aspect of the present invention, an installation apparatus for an undersea umbilical is provided the includes means for receiving a terminating end of the umbilical, means for guiding the terminating end of the umbilical, the means for guiding operable to be received by the means for receiving, and means for securing the terminating end of the umbilical to the means for receiving.

According to another aspect of the present invention, an installation apparatus is provided that includes a coupling member defining a plurality of receiving holes, a guide member comprising a plurality of guide arms, the plurality of guide arms operable to be received by the plurality of receiving holes, an actuator coupled to the guide member, the actuator operable to retract the plurality of guide arms to the guide member, a plurality of engagement members on each guide arm, the engagement members operable to retract to the guide arm, a handle coupled to the guide member, the handle operable to manipulate the guide member, a securing member operable to couple to the coupling member and secure a device to the coupling member, and a plurality of securing supports coupled to the coupling member, the plurality of securing supports operable to couple the securing member to the coupling member.

According to another aspect of the present invention, an installation apparatus is provided that includes a guide member defining a semi-circular channel, a pair of bases coupled to the guide member, the bases situated on opposite sides of the channel, a pair of guide arm moveably coupled to the pair of bases, the guide arms operable to extend from and retract to their respective bases, a plurality of engagement members pivotally coupled to each guide arm, and a handle coupled to the guide member operable to manipulate the guide member.

According to another aspect of the present invention, an installation apparatus is provided that includes a coupling member comprising a plurality of connectors, a plurality of receiving holes defined by the coupling member and situated adjacent the plurality of connectors, a plurality of securing supports extending from a surface of the coupling member and adjacent the plurality of connectors, a securing hole defined by each securing support, a securing member comprising a plurality of arms, the plurality of arms operable to couple the securing member to the coupling member by situating the plurality of arms in the securing holes defined by the plurality of securing supports, and a handle coupled to the securing member operable to manipulate the securing member.

According to another aspect of the present invention, an undersea umbilical is provided that includes a terminating end coupled to the umbilical, the terminating end comprising a plate defining a plurality of guide holes, a coupling member comprising a plurality of connectors coupled to the terminating end, a plurality of receiving holes defined by the coupling member, the plurality of receiving holes operable to line up with the plurality of guide holes, a plurality of securing supports extending from a surface of the coupling member and adjacent the plurality of connectors, a securing hole defined by each securing member, a securing member comprising a plurality of arms, the plurality of arms securing the terminating end to the connectors by situating the plurality of arms in the securing holes defined by the plurality of securing supports, and a handle coupled to the securing member operable to manipulate the securing member.

According to another aspect of the present invention, a method for installing an undersea umbilical is provided that includes providing a terminating end on the umbilical, providing a connector operable to couple to the terminating end, guiding the terminating end to the connector, whereby the guiding comprises providing a guide member, coupling the guide member to the terminating end, and moving the guide member; aligning the terminating end to connect to the connector, whereby the aligning comprises providing a guide member comprising a guide arm, providing a receiving member adjacent the connector, coupling the guide arm to the terminating end, and locating the guide arm in the receiving member; connecting the terminating end to the connector, whereby the connecting comprises providing a guide member comprising a guide arm, providing a receiving member adjacent the connector, coupling the guide arm to the terminating end, locating the guide arm to the receiving member, coupling the guide arm to the receiving member, and retracting the guide arm to engage the terminating end and the connector; and securing the terminating end to the connector, whereby the securing comprises providing a securing support adjacent the connector, providing a securing member, and coupling the securing member to the securing support, whereby with the securing member coupled to the securing support, the securing member abuts the terminating end.

According to another aspect of the present invention, an installation apparatus for an undersea umbilical is provided that includes means for receiving a terminating end of the umbilical, means for guiding the terminating end of the umbilical, the means for guiding operable to be received by the means for receiving, means for manipulating the means for guiding coupled to the means for guiding, means for engaging the means for receiving coupled to the means for guiding, means for retracting the means for engaging to the means for guiding coupled to the means for engaging, means for securing the terminating end of the umbilical to the means for receiving, and means for supporting the means for securing coupled to the means for receiving.

DETAILED DESCRIPTION

Figure 1:
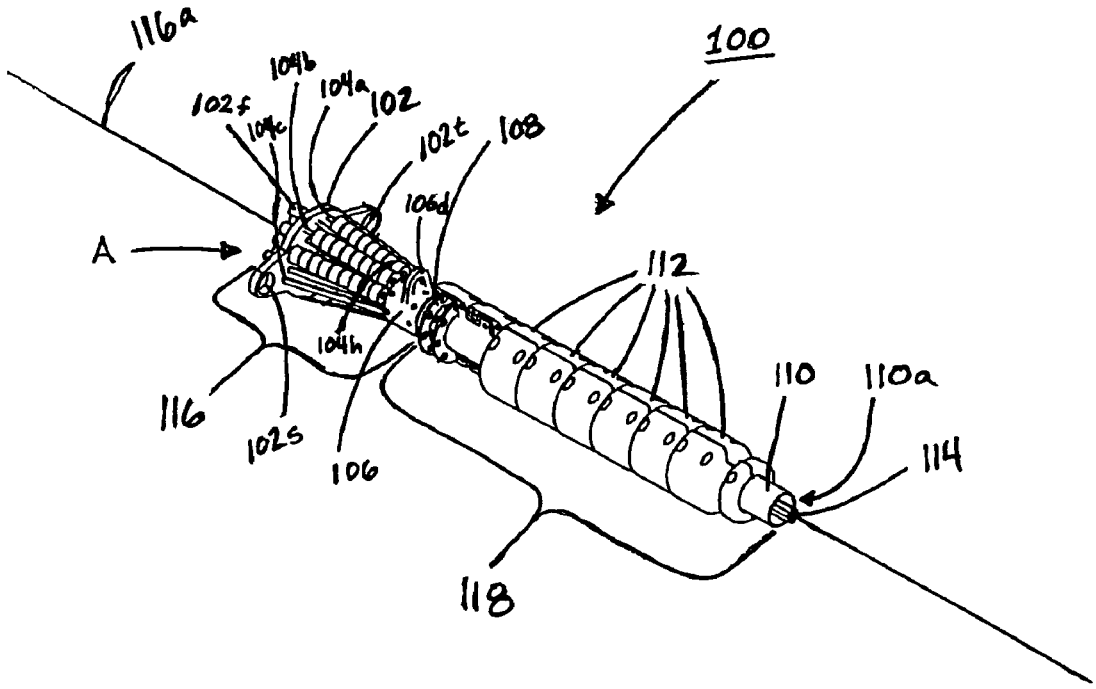
FIG. 1 is a perspective view illustrating an embodiment of a termination system including a partial cross sectional view of a plurality of bend limiters.
Figure 2A:
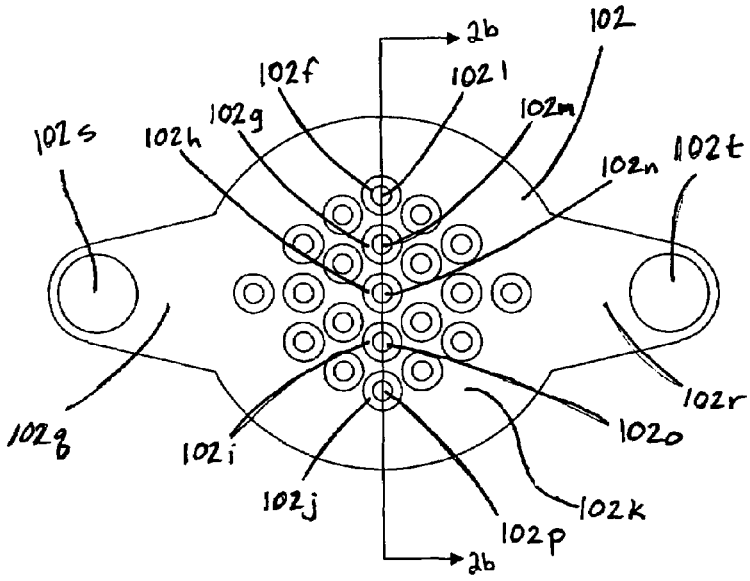
FIG. 2*a* is a front view illustrating an embodiment of a plate used in the termination system of FIG. 1.
Figure 2B:
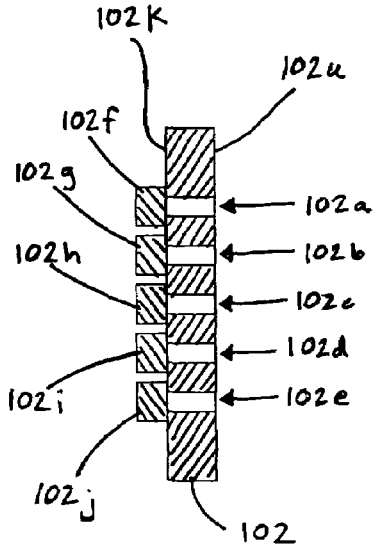
FIG. 2*b* is a side cross sectional view, taken along line 2*b* of FIG. 2*a*, illustrating an embodiment of a plate used in the termination system of FIG. 1.
Figure 3:
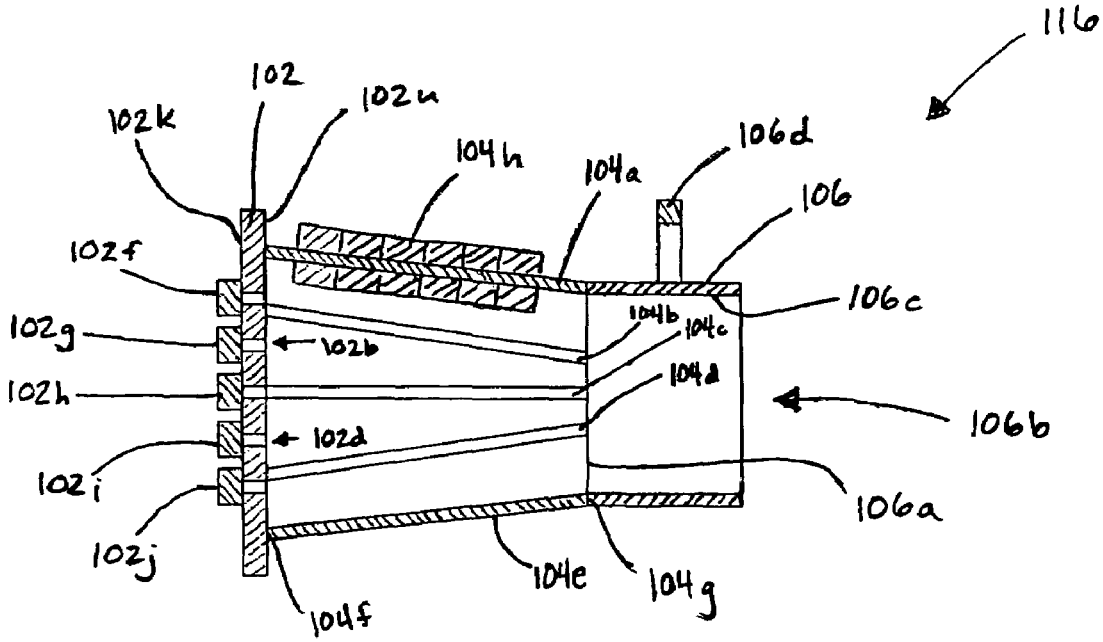
FIG. 3 is a side cross sectional view illustrating an embodiment of a connection member used in the termination system of FIG. 1.
Figure 4:
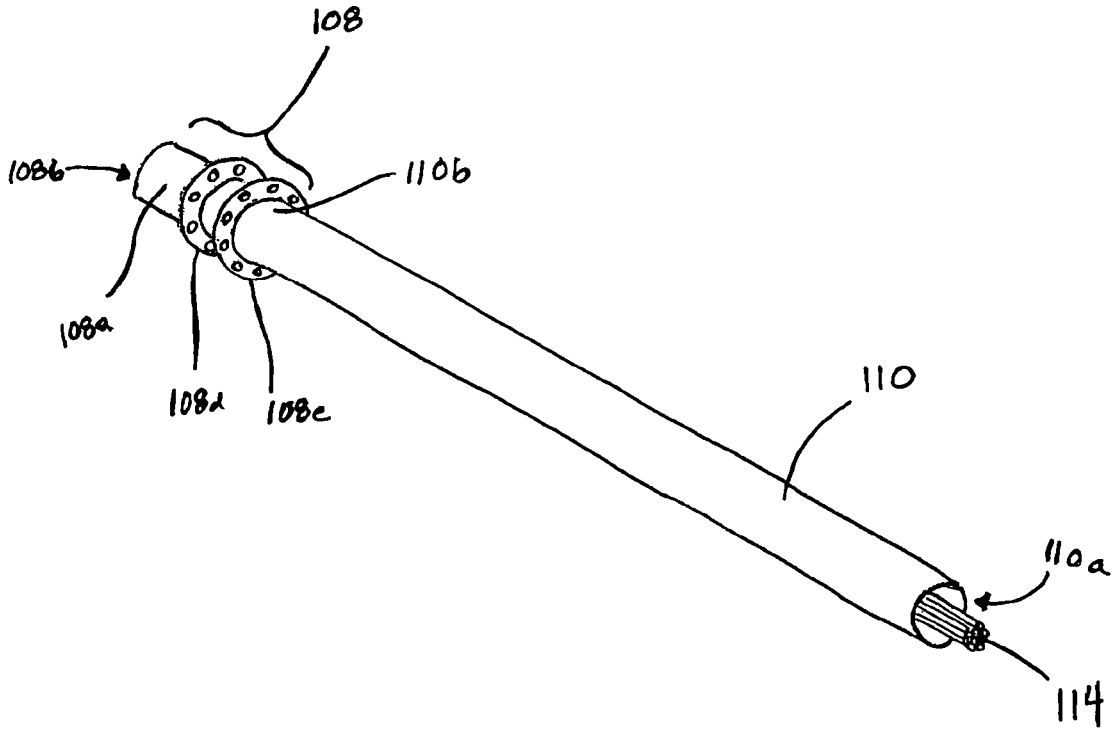
FIG. 4 is a perspective view illustrating an embodiment of an overhose and adapter used in the termination system of FIG. 1.
Figure 5A:
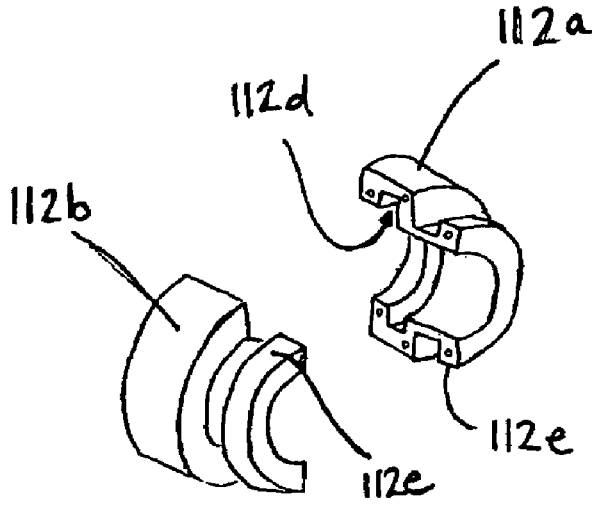
FIG. 5*a* is a perspective view illustrating an embodiment of a bend limiter used in the termination system of FIG. 1.
Figure 5B:
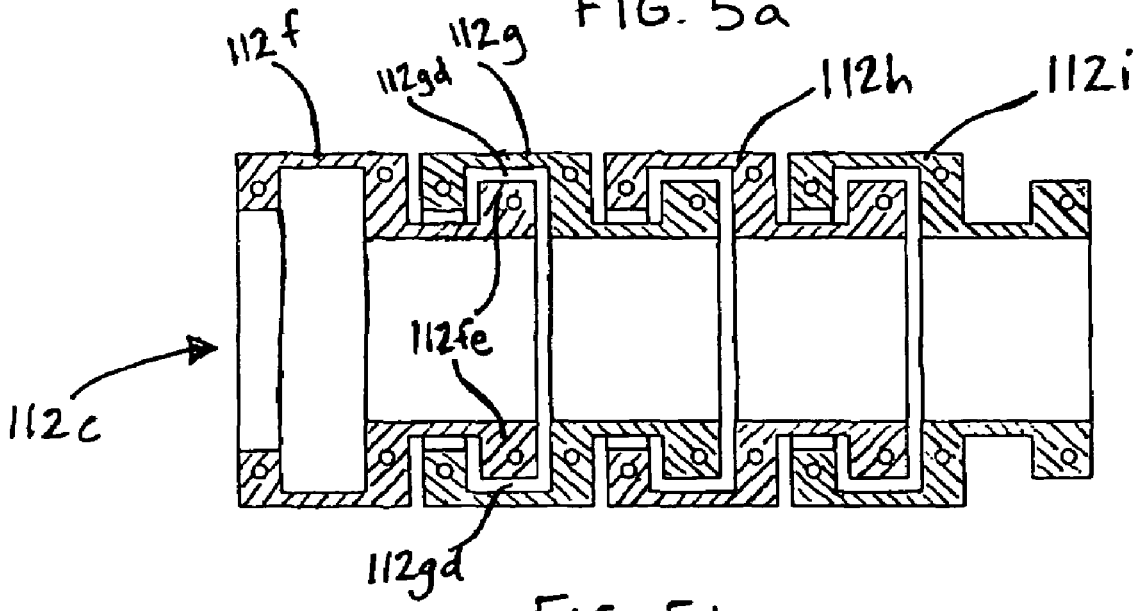
FIG. 5*b* is a side cross sectional view illustrating an embodiment of a plurality of bend limiters used in the termination system of FIG. 1.
Figure 6:
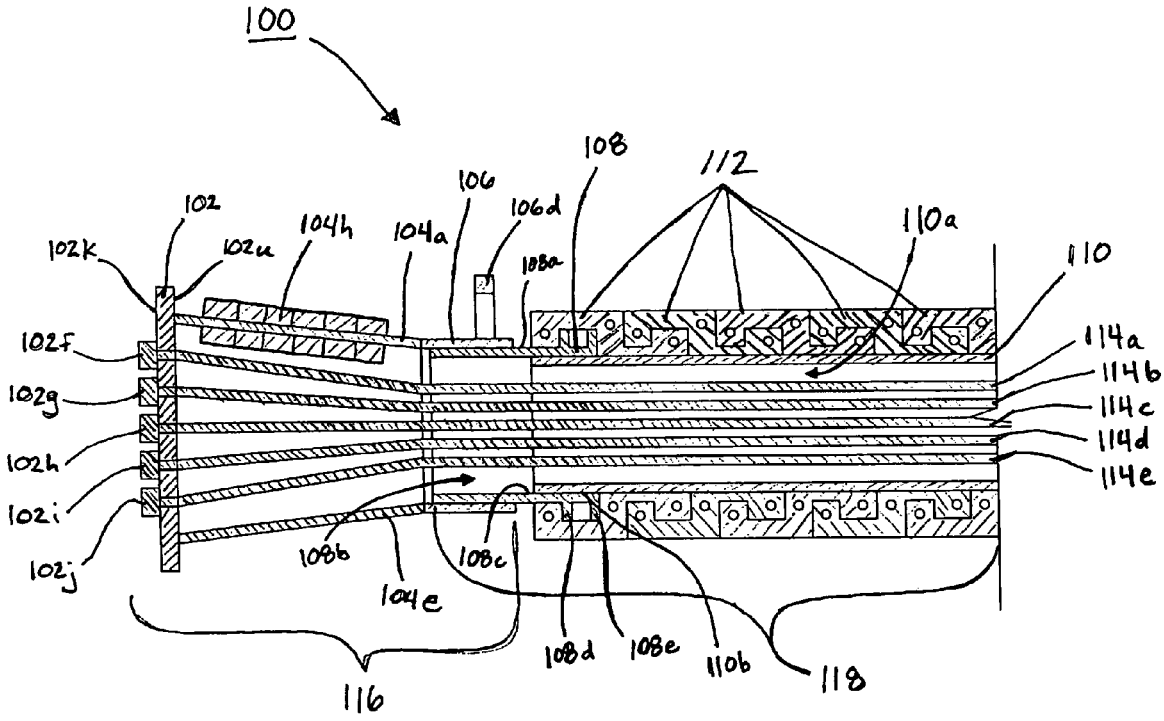
FIG. 6 is a side cross sectional view illustrating an embodiment of the termination system of FIG. 1.
Figure 7:
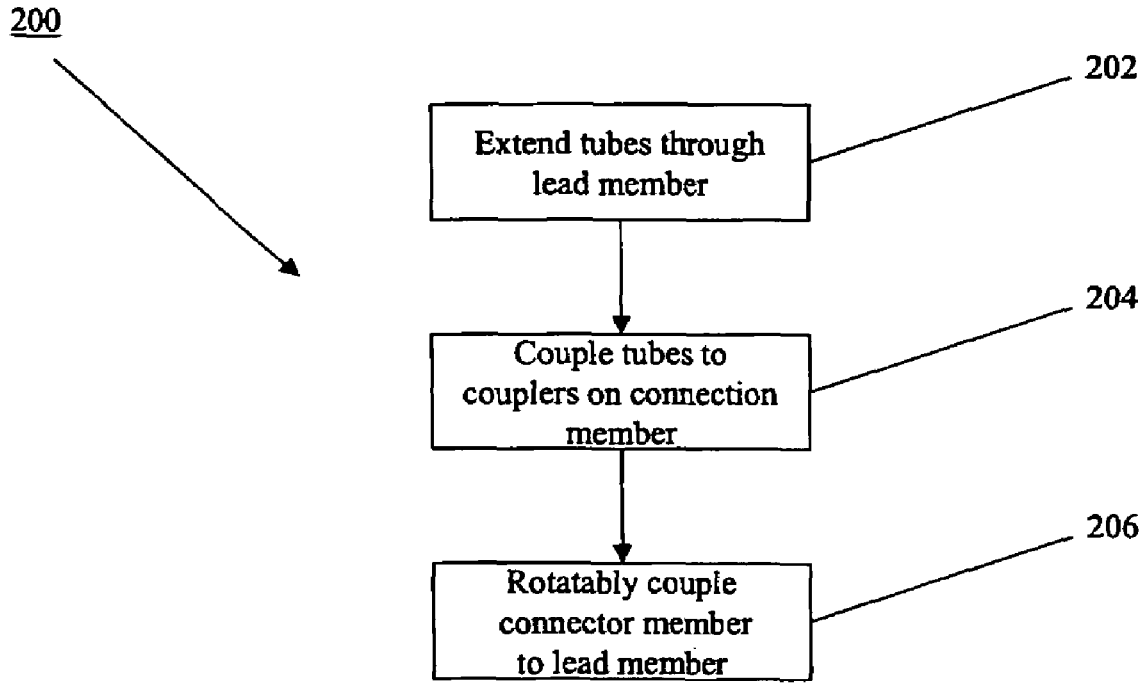
FIG. 7 is a flow chart illustrating an embodiment of a method for termination using the termination system of FIG. 1.

Referring initially to FIGS. 1, 2*a*, 2*b*, 3, 4, 5*a*, 5*b*, and 6 of the drawings, an exemplary embodiment of a termination system 100 is illustrated which includes a plate 102. The plate 102 defines a plurality of longitudinally oriented coupling holes, such as holes 102*a*, 102*b*, 102*c*, 102*d*, and 102*e*. A plurality of tube couplers, such as couplers 102*f*, 102*g*, 102*h*, 102*i*, and 102*j*, are coupled to and extend from a surface 102*k* on plate 102. The couplers 102*f-j* include respective system connectors 102*l*, 102*m*, 102*n*, 102*o*, and 102*p* on their surfaces. A pair of guide flanges 102*q* and 102*r* extend from opposite sides of plate 102 and define guide holes 102*s* and 102*t*, respectively. A surface 102*u* is situated opposite surface 102*k* on plate 102.

A plurality of connection bars, such as connection bars 104*a*, 104*b*, 104*c*, 104*d*, and 104*e*, each include an end, such as end 104*f* on connection bar 104*e*, which is circumferentially spaced apart from adjacent connection bars 104 and coupled to the surface 102*u* on plate 102. The plurality of connection bars 104*a-e* extend from the surface 102*u* and have a second end, such as end 104*g* on connection bar 104*e*, which is circumferentially spaced apart from adjacent connection bars 104 and coupled to a collar 106 on a collar end face 106*a*. One or more of the connection bars 104*a-e* may receive one or more tubular buoyancy devices, such as buoyancy device 104*h* on bar 104*a*.

The collar 106 defines a passageway 106*b* running longitudinally through the collar 106, and includes a rotational coupling inner wall 106*c* situated adjacent the passageway 106*b* and along the length of collar 106. A handle 106*d* is coupled to and extends radially from an upper portion of the collar 106.

An adapter 108 may be coupled to the collar 106 through the coupling of a rotational coupling outer wall 108*a* on adapter 108 with the rotational coupling inner wall 106*c* on collar 106. Coupling the adapter 108 to the collar 106 allows for relative rotation between the adapter 108 and the collar 106. The adapter 108 defines a passageway 108*b* running the length of adapter 108, and includes an overhose coupling inner wall 108*c* situated adjacent the passageway 108*c* and along the length of adapter 108. A plurality of adapter flanges 108*d* and 108*e* are coupled to and extend radially from the adapter 108 about the circumference of adapter 108.

A tubular overhose 110 is received within and coupled to the adapter 108. Tubular overhose 110 defines a passageway 110*a* running the length of tubular overhose 110. An outer coupling surface 110*b* is including on tubular overhose 110 for coupling the tubular overhose 110 to the overhose coupling inner wall 108*c* on adapter 108.

A plurality of bend limiters 112 are coupled to the overhose 110. Each bend limiter 112 includes a plurality of bend limiter portions 112*a* and 112*b* which are coupled together to define a longitudinal passageway 112*c* that receives overhose 110. Each bend limiter portion 112*a* and 112*b* includes an internal annular groove 112*d* at one end and an external flange 112*e* at the other end. A plurality of bend limiters such as bend limiters 112*f* and 112*g* may couple to each other by situating the external flange 112*fe* on bend limiter 112*f* in the internal annular groove 112*gd* of bend limiter 112*g*. Additional bend limiters 112*h* and 112*i* may be coupled to bend limiters 112*f* and 112*g* in a similar manner in extend the longitudinal passageway 112*c* for receiving overhose 110. In an exemplary embodiment, the plurality of adapter flanges 108*d* and 108*e* are situated in the internal annular groove 112*d* of a bend limiter 112. In an exemplary embodiment, the bend limiters 112 are made of a buoyant material.

A plurality of conductors 114, such as conductors 114*a*, 114*b*, 114*c*, 114*d*, and 114*e*, may extend through passageway 110*a* defined by overhose 110, passageway 108*a* defined by adapter 108, passageway 106*b* defined by collar 106, and be coupled to couplers 102*f-j* through holes 102*a-e* defined by plate 102.

In an exemplary embodiment, the bend limiters 112 are provided substantially as described in U.S. Utility patent application Ser. No. 10/841,593, filed on May 7, 2004, the disclosure of which is incorporated herein by reference.

In an exemplary embodiment, the plate 102, bars 104, and collar 106 provide a connection member 116 for protecting the plurality of conductors 114, rotating relative to the overhose 110, and connecting the system to a connector. Connection member 116 includes a longitudinal axis 116*a*. In an exemplary embodiment, the adapter 108, overhose 110, and bend limiters 112 provide a tubular lead member 118 for protecting the plurality of conductors 114 and rotating relative to the connection member 116.

In an exemplary embodiment, during operation of the system 100, as illustrated in FIGS. 1, 2*a*, 2*b*, 3, 4, 5*a*, 5*b*, 6, and 7, a method 200 for termination is implemented using the system 100 in which, in step 202, the plurality of conductors 114 are extended through the tubular lead member 118 by way of the passageway 110*a* defined by tubular overhose 110. Once the conductors 114 are extended through the passageway 110*a*, at step 204, the conductors 114 are then extended through the passageway 108*a* defined by adapter 108, passageway 106*b* defined by collar 106, and through the holes 102*a-e* on plate 102 where they are coupled to the couplers 102*f-j* on connection member 116. With the conductors 114 coupled to the couplers 102*j*, at step 206, the collar 106 on connection member 116 is rotatably coupled to the adapter 108 on tubular lead member 118. With the collar 106 rotatably coupled to the adapter 108, the connection member 116 may rotate about the longitudinal axis 116*a*. With the conductors 114 coupled to the couplers 102*f-j* on connection member 116, when the connection member 116 rotates, the conductors 114 rotate in the passageway 110*a* of overhose 110, while the tubular lead member 118 may remain stationary. Tubular buoyancy devices, such as buoyancy device 104*h*, are provided on bars 104 that are connected to the upper portion of surface 102*u* on plate 102 such that when the system 100 is submerged in water, the connection member 116 will be held substantially in a predetermined position, such as position A illustrated in FIG. 1. In an exemplary embodiment, the plurality of conductors 114 include a means for transmission of a fluid, gas, electricity, or information. In an exemplary embodiment, the plurality of conductors 114 may, for example, include coaxial cable, fiber optic cable, a variety of other information conducting cables, pipelines, hoses, and a variety of other transmission means.

Figure 8A:
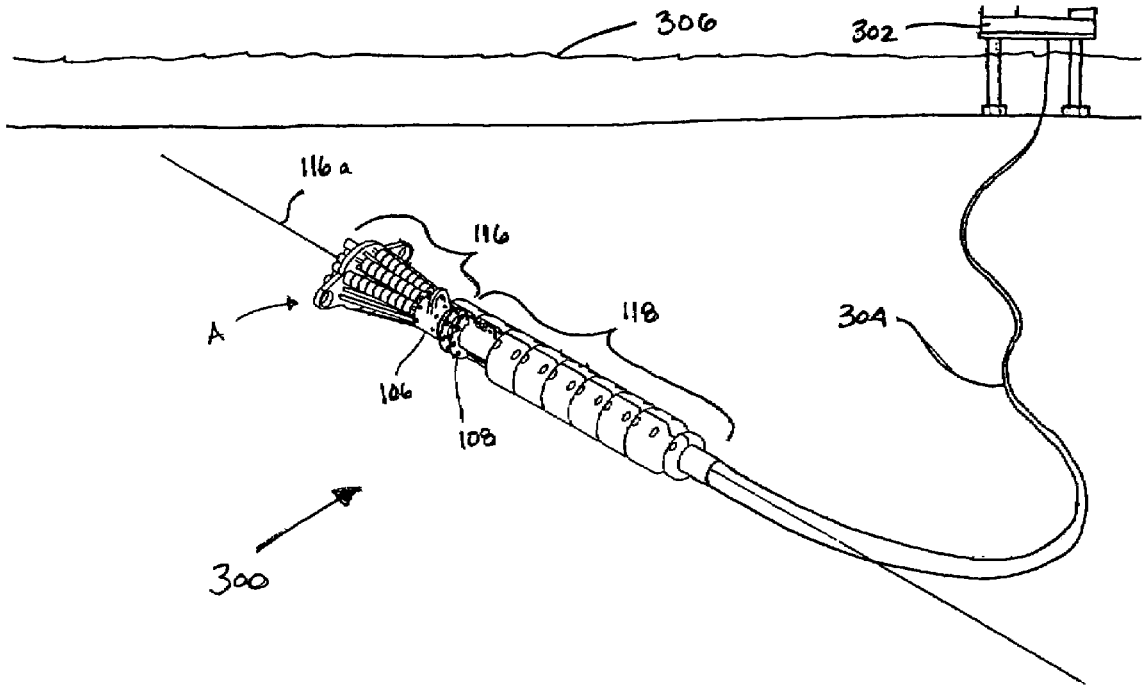
FIG. 8*a* is a perspective view illustrating an embodiment of the termination system of FIG. 1 coupled to a off-shore structure by an umbilical.
Figure 8B:
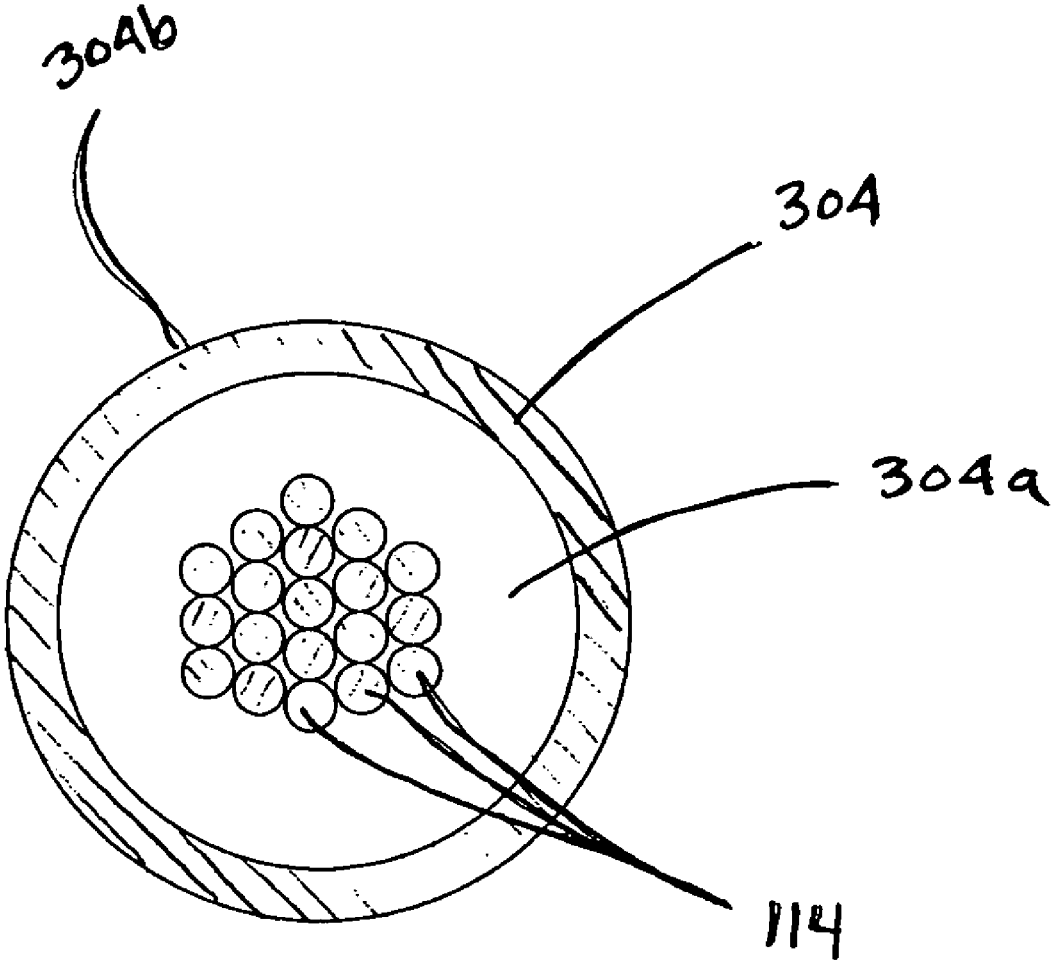
FIG. 8*b* is a front cross sectional view illustrating an embodiment of an umbilical used in the termination system of FIG. 8*a*.
Figure 9:
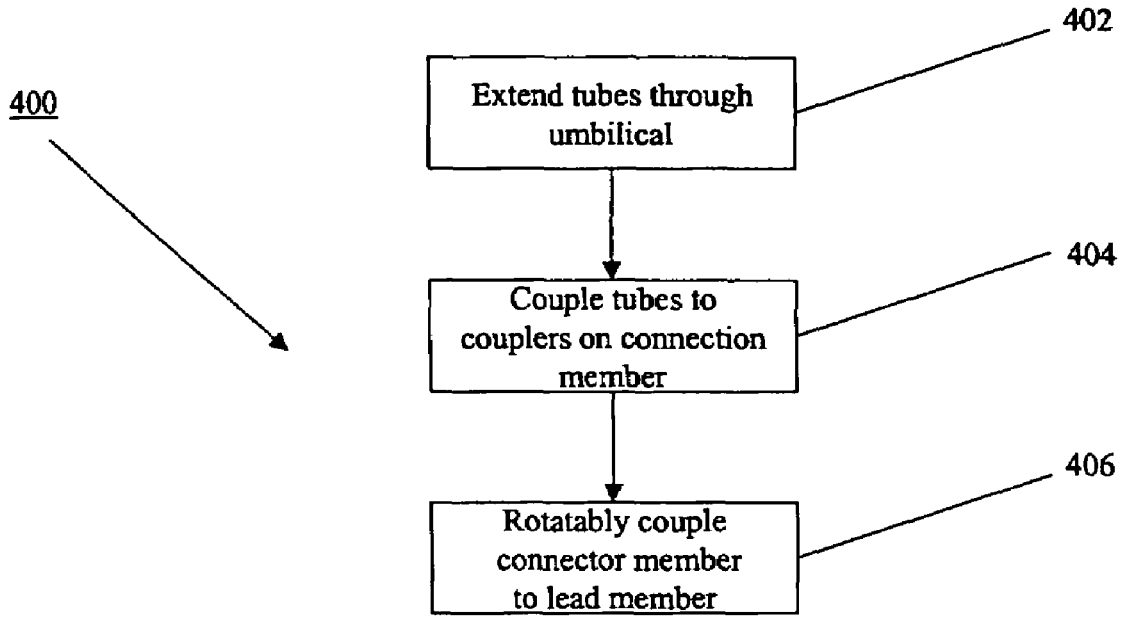
FIG. 9 is a flow chart illustrating an embodiment of a method for termination using the termination system of FIG. 8*a*.

Referring now to FIGS. 8*a* and 8*b*, an alternative embodiment of a termination system 300 is substantially identical in design and operation to the termination system 100 described above with reference to FIGS. 1-7 with the addition of an off-shore structure 302 and a tubular umbilical 304 situated underneath a body of water 306, a portion of the tubular umbilical 304 which replaces the overhose 110 of system 100, coupling the termination system 300 to the off-shore structure 302. The tubular umbilical 304 defines a passageway 304*a* which allows conductors 114 to extend through tubular umbilical 304 and includes an outer coupling surface 304*b* for coupling the tubular umbilical 304 to the overhose coupling inner wall 108*c* on adapter 108. The plurality of bend limiters 112 may be coupled to an end of the umbilical 304. In an exemplary embodiment, the off-shore structure 302 may be a ship, a free standing off-shore platform, floating off-shore platform, or a variety of other off-shore structures known in the art.

In an exemplary embodiment, during operation of the system 300, as illustrated in FIGS. 1, 2*a*, 2*b*, 3, 4, 5*a*, 5*b*, 6, 8*a*, 8*b*, and 9, a method 400 for terminating an umbilical is implemented using the system 300 in which, in step 402, the plurality of conductors 114 are situated in and extended through the passageway 304*a* defined by umbilical 304. Once the conductors 114 are extended through the passageway 304*a* defined by umbilical 304, at step 404, the conductors 114 are then extended through the passageway 108*a* defined by adapter 108, passageway 106*b* defined by collar 106, and through the holes 102*a-e* on plate 102 where they are coupled to the couplers 102*f-j* on connection member 116. With the conductors 114 coupled to the couplers 102*f-j*, at step 406, the collar 106 on connection member 116 is rotatably coupled to the adapter 108 on tubular lead member 118. With the collar 106 rotatably coupled to the adapter 108, the connection member 116 may rotate about the longitudinal axis 116*a*. With the conductors 114 coupled to the couplers 102*f-j* on connection member 116, when the connection member 116 rotates, the conductors 114 rotate in the umbilical 304, while the tubular lead member 118 and umbilical 304 may remain stationary. In an exemplary embodiment, the system 300 may then be situated beneath the body of water 306 while being coupled to the off-shore structure 302. Tubular buoyancy devices, such as buoyancy device 104*h*, are provided on bars 104 that are connected to the upper portion of surface 102*u* on plate 102 such that when the system 100 is submerged in water, the connection member 116 will be held substantially in a predetermined position, such as position A illustrated in FIG. 8*a*.

Figure 10A:
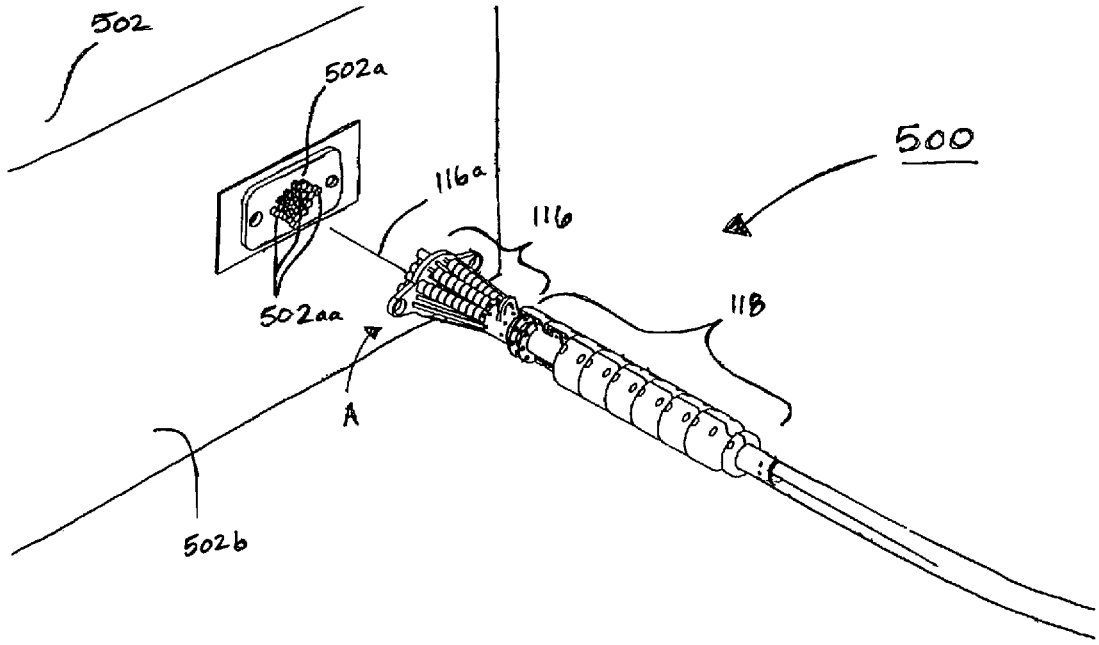
FIG. 10*a* is a perspective view illustrating an embodiment of the termination system of FIG. 8*a* used with an undersea well system.
Figure 10B:
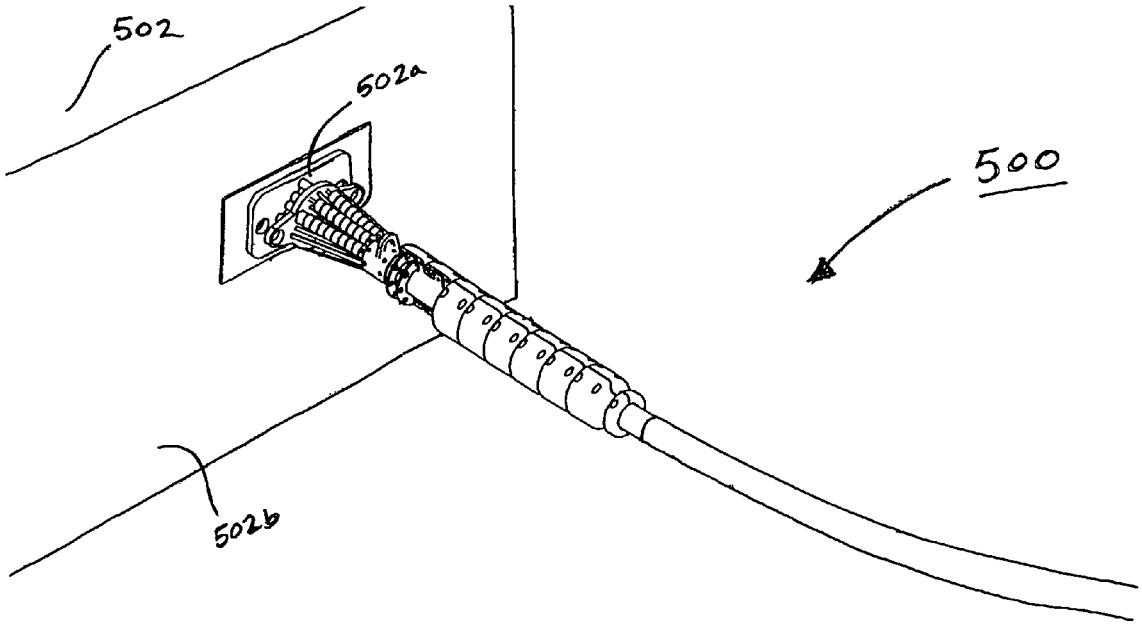
FIG. 10*b* is a perspective view illustrating an embodiment of the termination system of FIG. 8*a* connected to an undersea well system.
Figure 11:
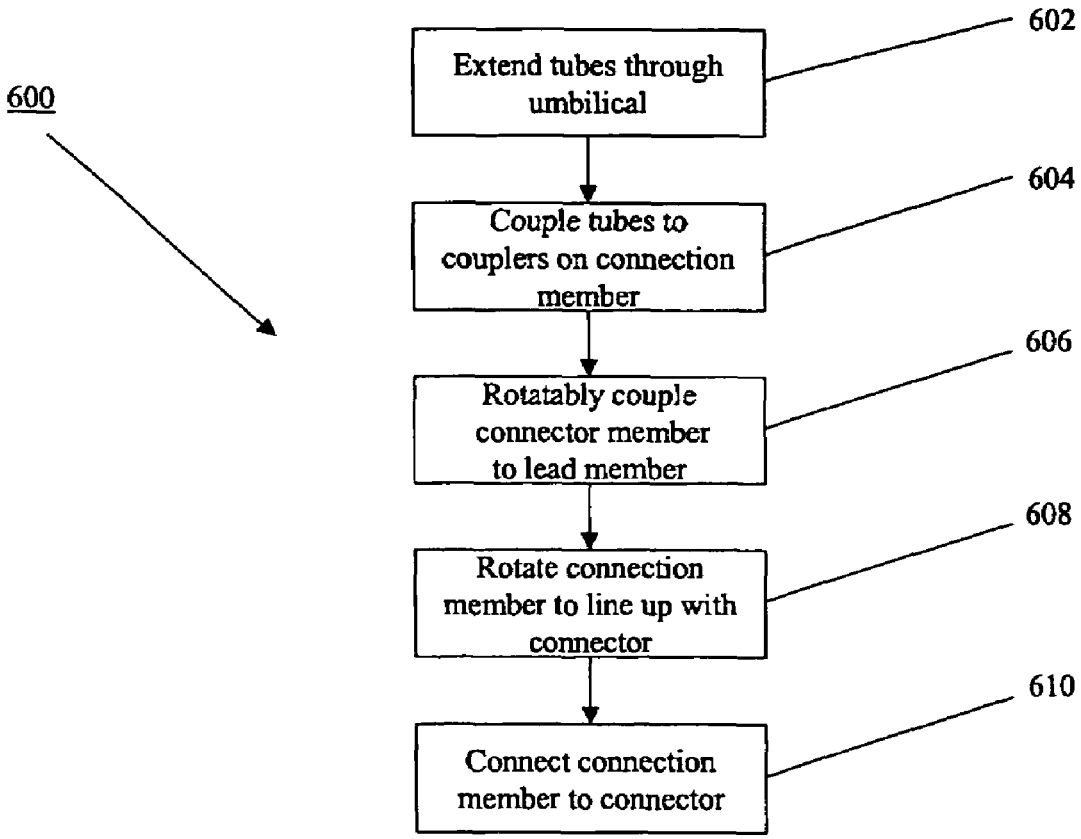
FIG. 11 is a flow chart illustrating an embodiment of a method for termination using the termination system of FIGS. 10*a* and 10*b*.
Figure 12:
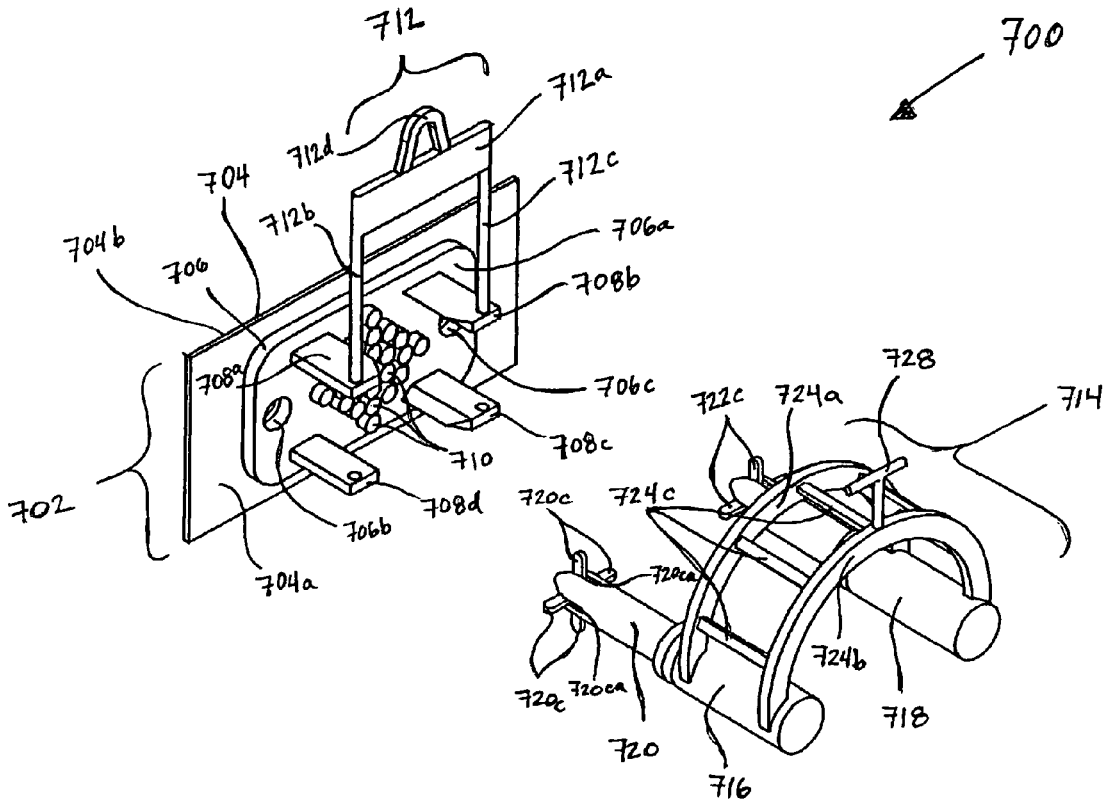
FIG. 12 is a perspective view illustrating an embodiment of an installation apparatus used with the termination system of FIGS. 1, 8*a*, and 10*a*.
Figure 13:
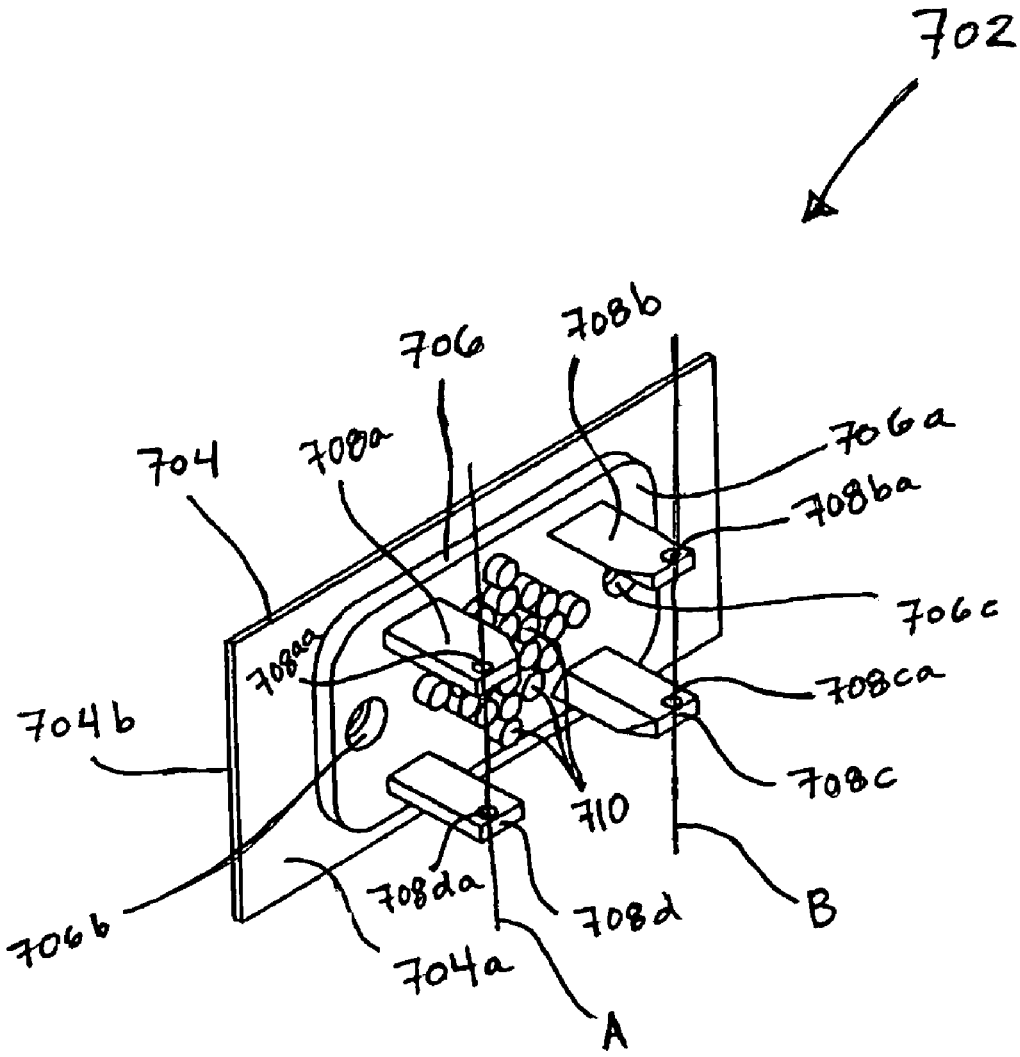
FIG. 13 is a perspective view illustrating an embodiment of a coupling member used in the installation apparatus of FIG. 12.
Figure 14:
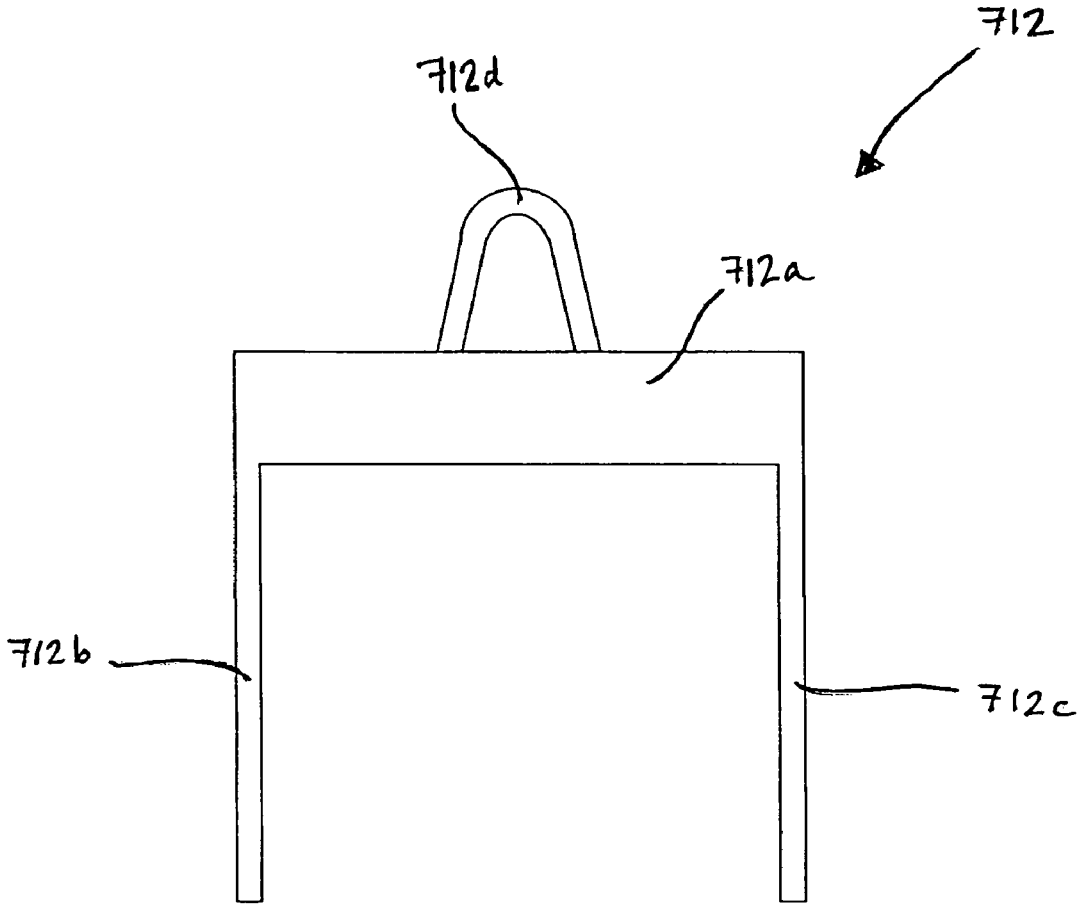
FIG. 14 is a front view illustrating an embodiment of a securing member used in the installation apparatus of FIG. 12.
Figure 15A:
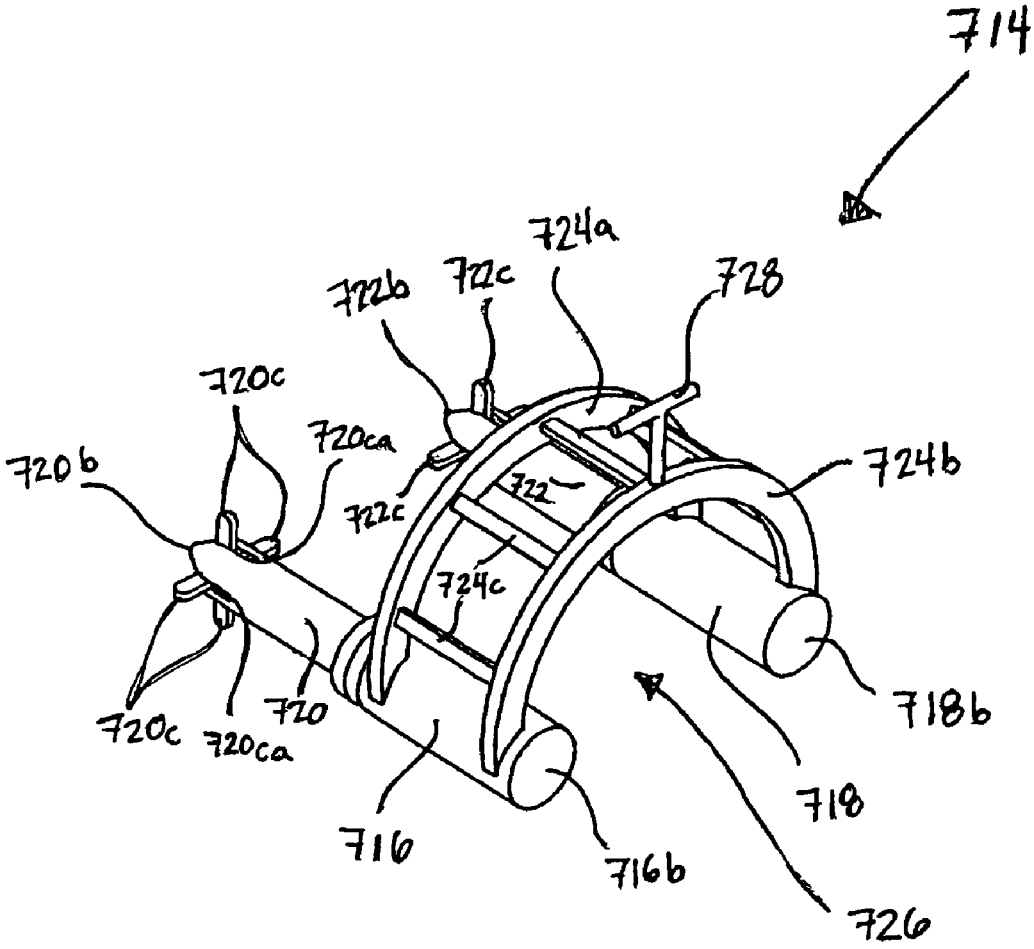
FIG. 15*a* is a perspective view illustrating an embodiment of a guide member used in the installation apparatus of FIG. 12.
Figure 15B:
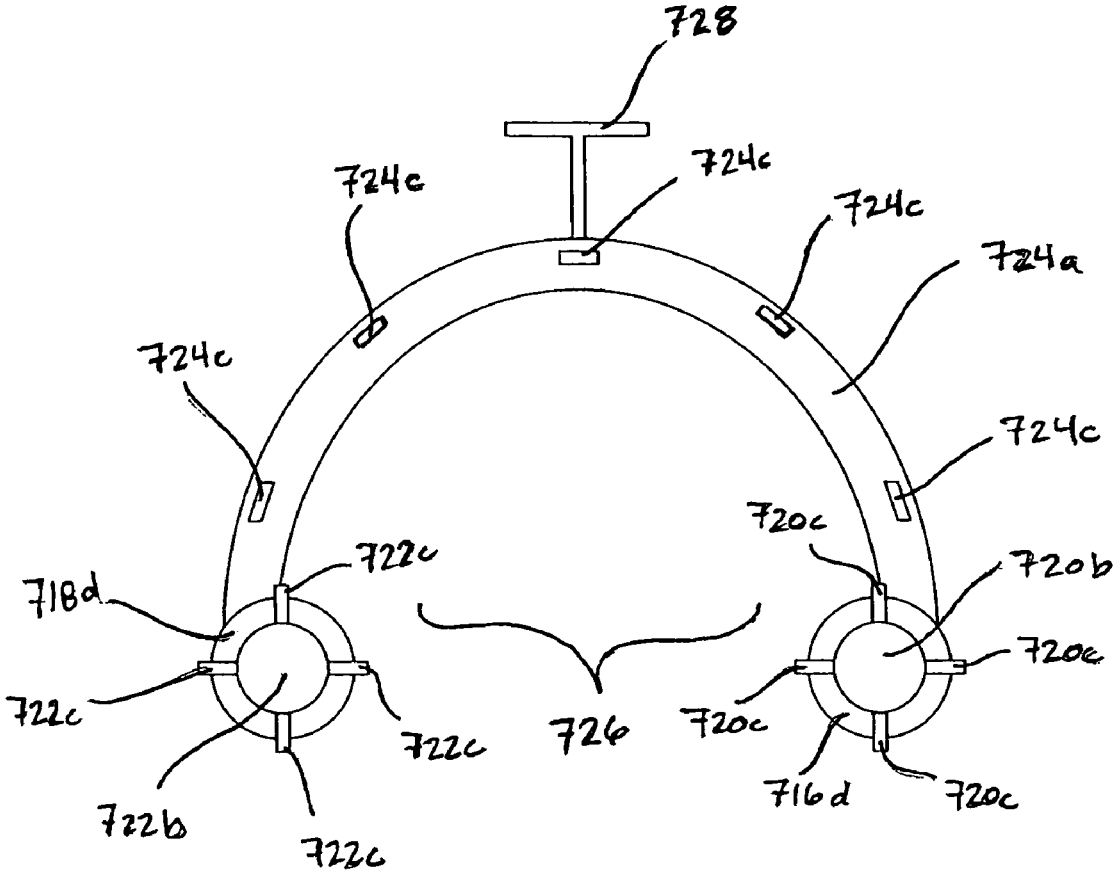
FIG. 15*b* is a front view illustrating an embodiment of the guide member of FIG. 15*a*.
Figure 15C:
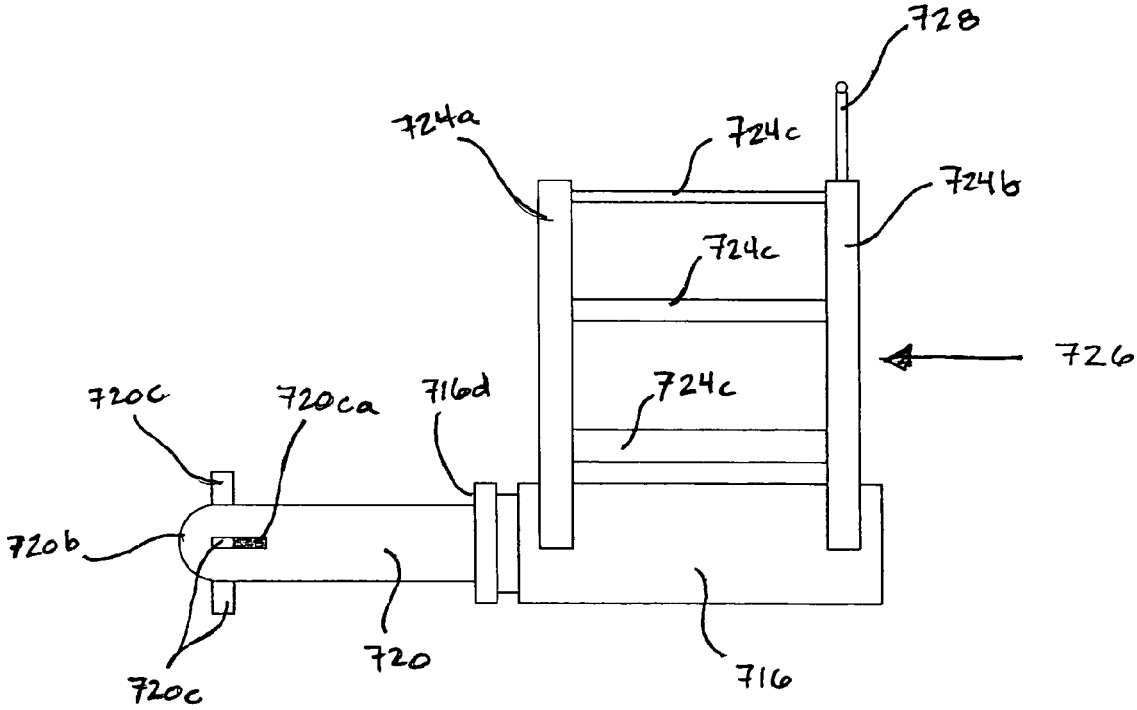
FIG. 15*c* is a side view illustrating an embodiment of the guide member of FIG. 15*a*.
Figure 15D:
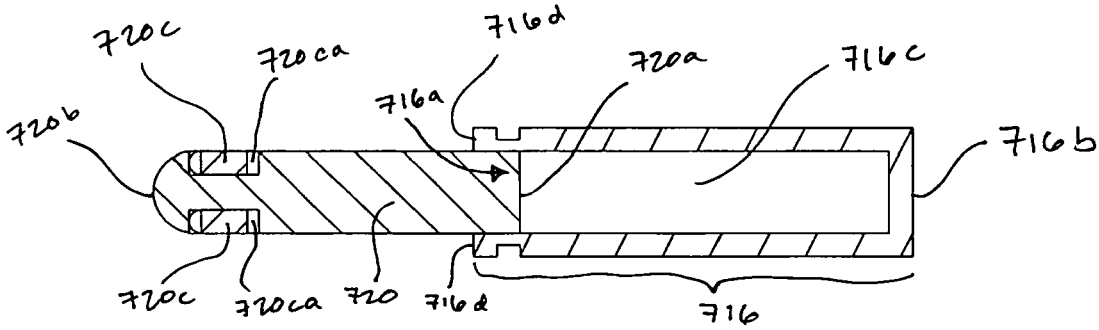
FIG. 15*d* is a cross sectional view illustrating an embodiment of a tubular base and guide arm used in the guide member of FIG. 15*a*.
Figure 15E:
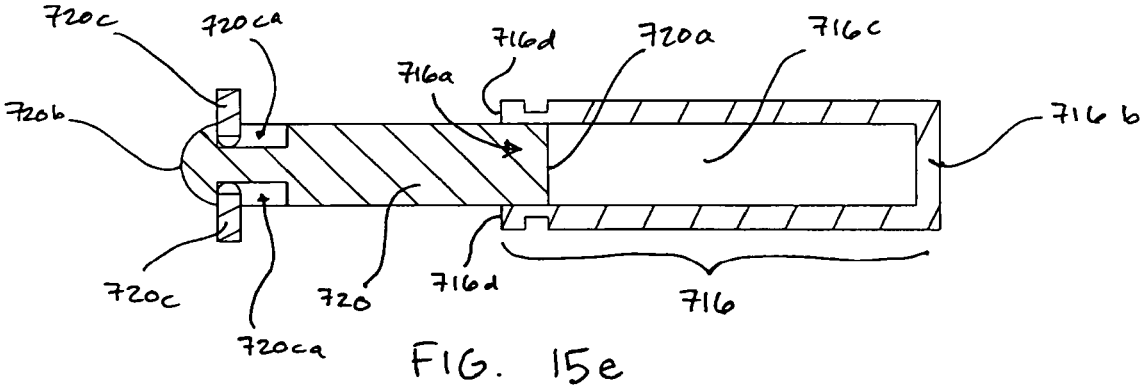
FIG. 15*e* is a cross sectional view illustrating an embodiment of a tubular base and guide arm used in the guide member of FIG. 15*a*.

Referring now to FIGS. 10*a* and 10*b*, an alternative embodiment of a termination system 500 is substantially identical in design and operation to the termination system 300 described above with reference to FIGS. 1-9 with the addition of an undersea well system 502 with a connector 502*a* on a surface 502*b* of undersea well system 502. Connector 502*a* includes a plurality of connections 502*aa*, corresponding to couplers 102*f-j* on connection member 116, which provide contacts for connections 102*l-p* on couplers 102*f-j*. In an exemplary embodiment, undersea well system 502 may be a well head or a variety of other sub-sea structures known in the art.

In an exemplary embodiment, during operation of the system 500, as illustrated in FIGS. 1, 2*a*, 2*b*, 3, 4, 5*a*, 5*b*, 6, 8*a*, 8*b*, 10, and 11, a method 600 for termination is implemented using the system 500 in which, in step 602, the plurality of conductors 114 are situated in and extended through the passageway 304*a* defined by umbilical 304. Once the conductors 114 are extended through the passageway 304*a* defined by umbilical 304, at step 604, the conductors 114 are then extended through the passageway 108*a* defined by adapter 108, passageway 106*b* defined by collar 106, and through the holes 102*a-e* on plate 102 where they are coupled to the couplers 102*f-j* on connection member 116. With the conductors 114 coupled to the couplers 102*f-j*, at step 606, the collar 106 on connection member 116 is rotatably coupled to the adapter 108 on tubular lead member 118. With the collar 106 rotatably coupled to the adapter 108, at step 608, the connection member 116 may rotate about the longitudinal axis 116*a*. With the conductors 114 coupled to the couplers 102*f-j* on connection member 116, when the connection member 116 rotates, the conductors 114 rotate in the umbilical 304, while the tubular lead member 118 and umbilical 304 may remain stationary. When the connection member 116 is lined up with the connections 502*aa* on connector 502*a*, in step 610, the connection member 116 is connected to the connector 502*a*. In an exemplary embodiment, the system 300 may then be situated beneath a body of water 306 while being coupled to the off-shore structure 302, and the connection to the undersea well system 502 may transmit information from undersea well system 502, through conductors 114, and up to off-shore structure 302. Tubular buoyancy devices, such as buoyancy device 104*h*, are provided on bars 104 that are connected to the upper portion of surface 102*u* on plate 102 such that when the system 100 is submerged in water, the connection member 116 will be held substantially in a predetermined position, such as position A illustrated in FIG. 10*a* which substantially lines up connection member 116 to connect with connector 502*a*.

Referring now to FIGS. 12, 13, 14, 15*a*, 15*b*, 15*c*, 15*d*, and 15*e*, an exemplary embodiment of an installation apparatus 700 is illustrated which may be used to install a termination system such as the termination systems 100, 300, and 500 illustrated and described with reference to FIGS. 1, 2*a*, 2*b*, 3, 4, 5*a*, 5*b*, 6, 8*a*, 8*b*, 10*a*, and 10*b*. The installation apparatus 700 includes a coupling member 702. The coupling member 702 includes a chassis 704 which has a chassis front surface 704*a* and a chassis rear surface 704*b* which is opposite the chassis front surface 704*a*. A connector 706 is situated on the chassis front surface 704*a* of chassis 704 and includes a connector front surface 706*a*. In an exemplary embodiment, the connector 706 may be the connector 502*a* of FIGS. 10*a* and 10*b*. The connector 706 and the chassis 704 includes a plurality of receiving members 706*b* and 706*c* and, in an exemplary embodiment, the receiving members 706*b* and 706*c* are holes defined by the connector 706 and the chassis 704 which extend from connector front surface 706*a* to chassis rear surface 704*b*. A plurality of securing supports 708*a*, 708*b*, 708*c*, and 708*d* extend substantially perpendicularly from the connector front surface 706*a*. The plurality of securing supports 708*a*, 708*b*, 708*c*, and 708*d* each define a respective hole 708*aa*, 708*ba*, 708*ca*, and 708*da* on a distal end, with holes 708*aa* and 708*da* lying substantially along the same axis A, and holes 708*ba* and 708*ca* lying substantially along the same axis B. A plurality of connections 710 are situated on the connector front surface 706*a* and adjacent the plurality of securing supports 708*a*, 708*b*, 708*c*, and 708*d*. In an exemplary embodiment, the plurality of connections 710 may be the plurality of connections 502*aa* illustrated in FIG. 10*a*.

The installation apparatus 700 also includes a securing member 712. The securing member 712 has a base 712*a* including a plurality of spaced apart arms 712*b* and 712*c* extending from the base 712*a* which are substantially parallel to each other. A handle 712*d* is coupled to the base 712*a* on the securing member 712 opposite the plurality of arms 712*b* and 712*c*.

The installation apparatus 700 also includes a guide member 714. The guide member 714 has a pair of tubular bases 716 and 718. Tubular base 716 has an inlet 716*a*, a closed end 716*b* opposite the inlet 716*a*, and defines a cavity 716*c* extending from the inlet 716*a* to the closed end 716*b*. A circular lip 716*d* is included on the tubular base 716 adjacent the inlet 716*a*. Tubular base 716 is coupled to a guide arm 720 with a rear end 720*a* and front end 720*b*. The rear end 720*a* of guide arm 720 is moveably situated in the cavity 716*c*. A plurality of tabs 720*c* are pivotally coupled to the guide arm 720 adjacent the front end 720*b* and situated in a plurality of channels 720*ca* defined by guide arm 720. Tubular base 718 is substantially similar to tubular base 716 and include a guide arm 722 which is substantially similar to guide arm 720. The pair of tubular bases 716 and 718 are coupled to each other by a plurality of spaced apart, arcuate bars 724*a* and 724*b* which define a guide member channel 726. Arcuate bar 724*a* is coupled to the pair of tubular bases 716 and 718 adjacent the inlets 716*a* and 718*a* and arcuate bar 724*b* is coupled to the pair of tubular bases 716 and 718 adjacent the closed ends 716*b* and 718*b*. A plurality of beams 724*c* are coupled to and extend between the arcuate bars 724*a* and 724*b*. A T-shaped handle 728 is coupled to an upper portion of arcuate bar 724*b*.

Figure 16:
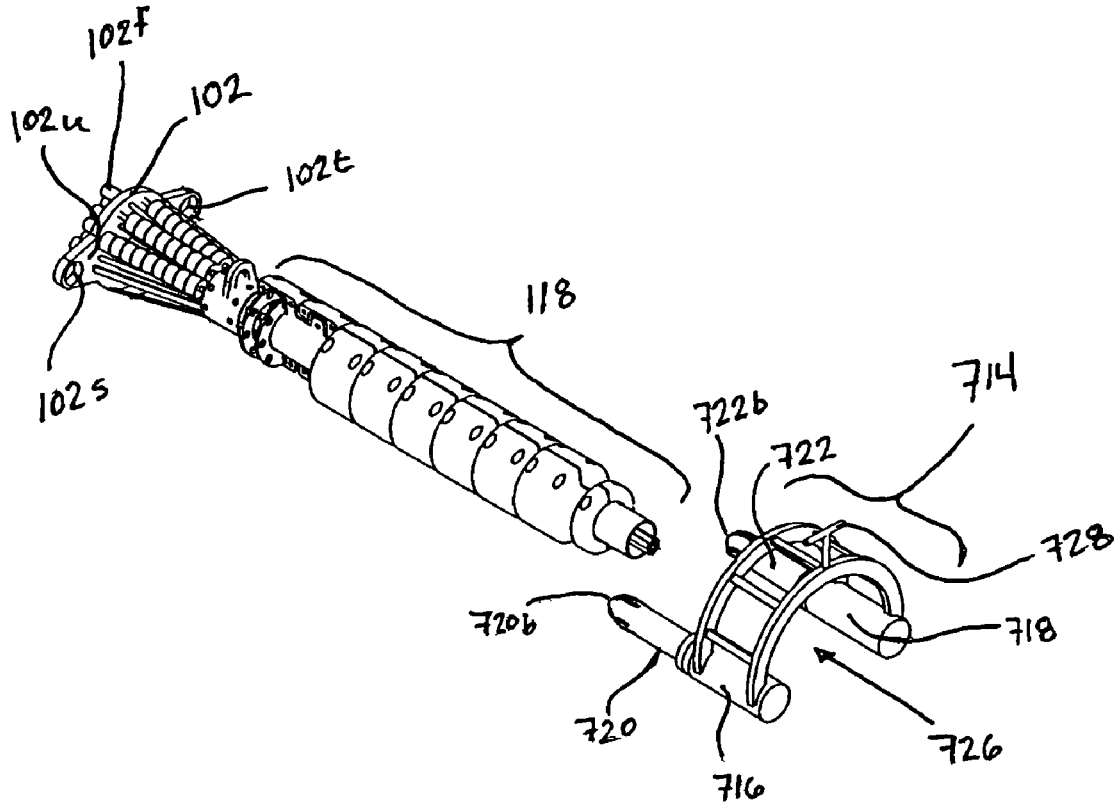
FIG. 16 is a perspective view illustrating an embodiment of the termination system of FIG. 1 and the guide member of FIG. 15*a*.

In an exemplary embodiment, during operation of the apparatus 700, as illustrated in FIGS. 12, 13, 14, 15*a*, 15*b*, 15*c*, 15*d*, 15*e*, 16, 17, 18, 19, 20, and 21, a method 800 for termination is implemented using the system 700 in which, in step 802, as illustrated in FIG. 16, the termination system, such as termination systems 100, 300, or 500 illustrated and described with reference to FIGS. 1, 2*a*, 2*b*, 3, 4, 5*a*, 5*b*, 6, 8*a*, 8*b*, 10*a*, and 10*b*, is located in the guide member channel 726 such that tubular base 716 with guide arm 720 situated on an opposite side of the tubular lead member 118 as tubular base 718 with guide arm 722. The plurality of tabs 720*c* and the plurality of tabs 722*c* are retracted into their respective guide arms 720 and 722 such that the tabs 720*c* and 722*c* are situated in their corresponding channels 720*ca* and 722*ca*. In an exemplary embodiment, the plurality of tabs 720*c* and 722*c* may be hydraulically actuated and extended from or retracted into the guide arms 720 and 722 by rotating the handle 728 in a particular direction.

Figure 17:
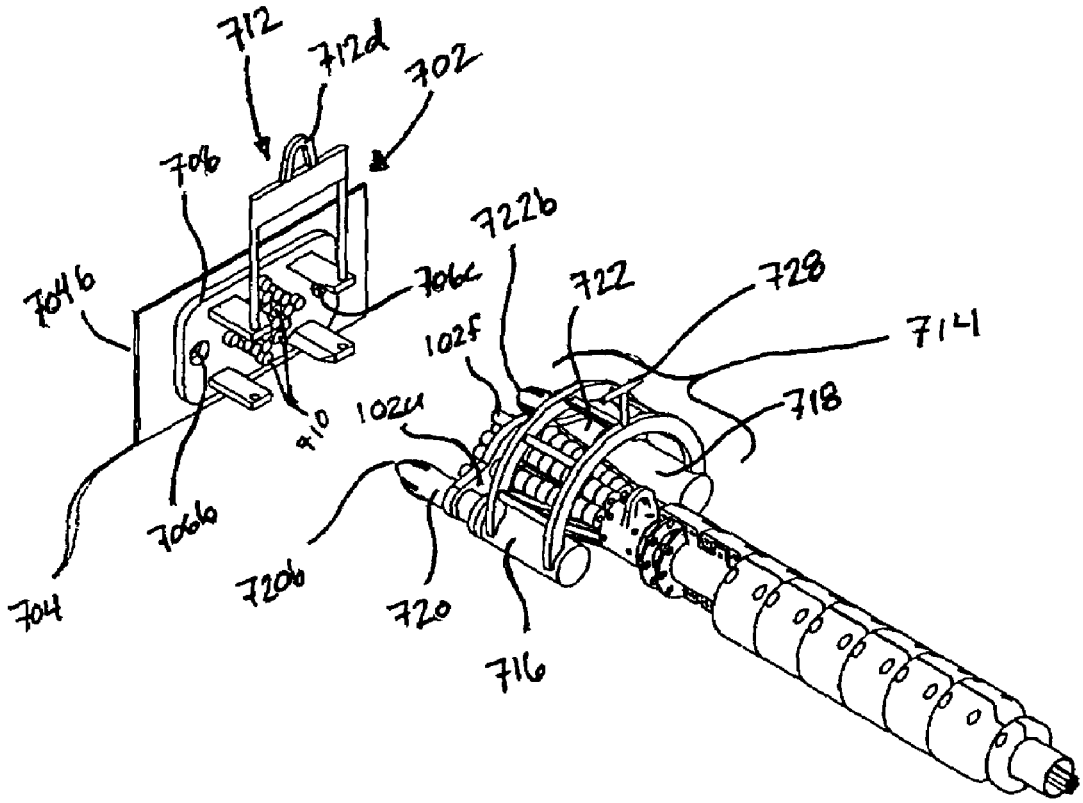
FIG. 17 is a perspective view illustrating an embodiment of the installation apparatus of FIG. 12 being used with the termination system of FIG. 1.

With the termination system located in the guide member channel 726, at step 804, as illustrated in FIG. 17, the guide member 714 is brought towards the plate 102 such that front end 720*b* of guide arm 720 is lined up with the guide hole 102*s* on plate 102, and front end 722*b* of guide arm 722 is lined up with guide hole 102*t* on plate 102. The guide arms 720 and 722 are then placed through the guide holes 102*s* and 102*t*, respectively, such that circular lips 716*d* and 718*d* engage surface 102*u* on plate 102.

Figure 18:
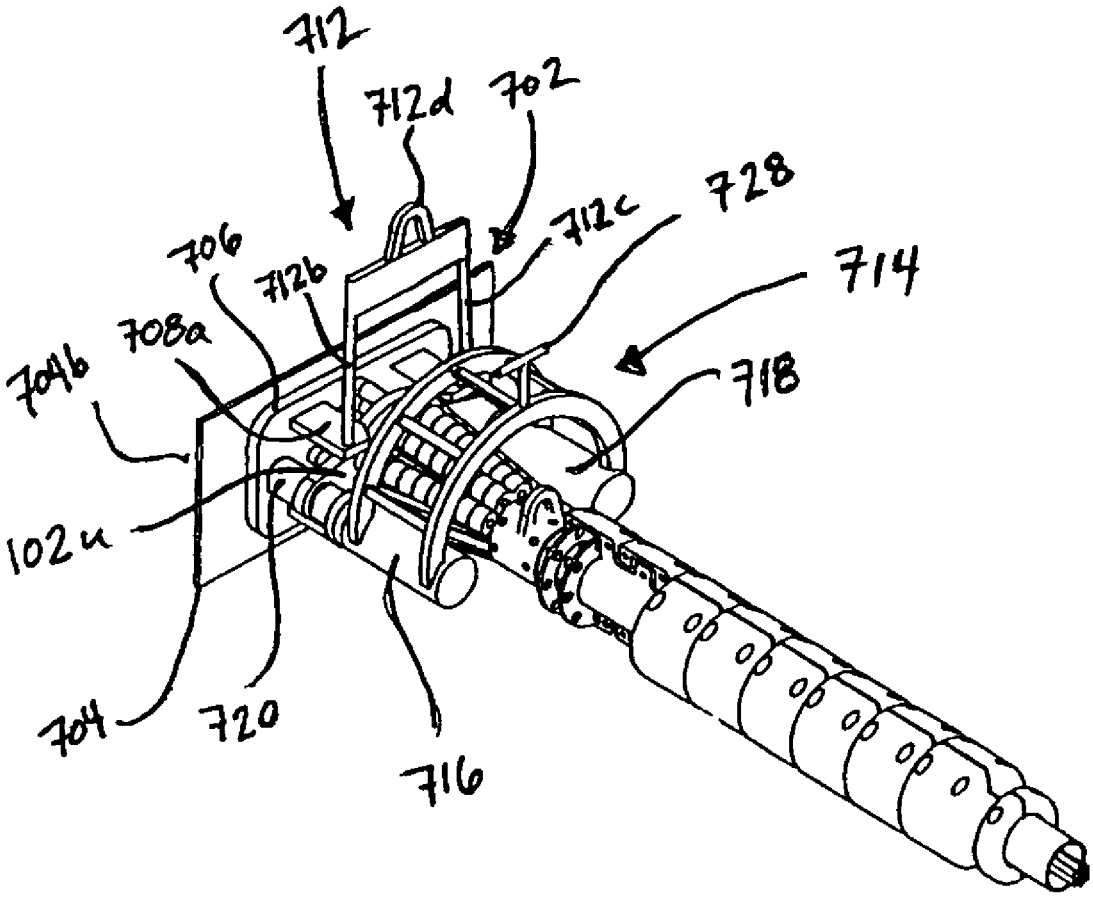
FIG. 18 is a perspective view illustrating an embodiment of the installation apparatus of FIG. 12 being used with the termination system of FIG. 1.

With guide arms 720 and 722 in respective guide holes 102*s* and 102*t*, the termination system may be manipulated by moving the guide member 714 and, at step 806, as illustrated in FIG. 18, the guide member 714 guides the termination system towards the coupling member 702. In an exemplary embodiment, the guide member 722 may be manipulated through use of the handle 728. The guide arm 720 is then placed in receiving member 706*b* and guide arm 722 is placed in receiving member 706*c* on coupling member 702 such that front end 720*b* of guide arm 720 and front end 722*b* of guide arm 722 extend out past chassis rear surface 704*b* on coupling member 702. When the guide arms 720 and 722 are placed in the receiving members 706*b* and 706*c*, the couplers, such as couplers 102*f*, 102*g*, 102*h*, 102*i*, and 102*j* on plate 102 line up with corresponding connections 710 on coupling member 702.

With the guide arms 720 and 722 located in respective receiving members 706*b* and 706*c*, at step 808, the tabs 720*c* on guide arm 720 and the tabs 722*c* and guide arm 722 are pivotally extended out from their respective channels 720*ca* and 722*ca*. In an exemplary embodiment, the plurality of tabs 720*c* and 722*c* may be hydraulically actuated and extended from or retracted into the guide arms 720 and 722 by rotating the handle 728 in a particular direction.

At step 810, the guide arms 720 and 722 may be retracted into their respective cavities 716*c* and 718*c* on respective tubular bases 716 and 718 such that tabs 720*c* and 722*c* engage chassis rear surface 704*b* on coupling member 702. With the tabs 720*c* and 722*c* engaging the coupling member 702, further retracting of the guide arms 720 and 722 into the tubular bases 716 and 718 brings plate 102 on the termination system towards coupling member 702 and mates couplers, such as couplers 102*f*, 102*g*, 102*h*, 102*i*, and 102*j*, with their corresponding connections 710. In an exemplary embodiment, the guide arms 720 and 722 may be actuated and extended from or retracted into the cavities 716*c* and 718*c* by rotating the handle 728 in a predetermined direction.

Figure 19:
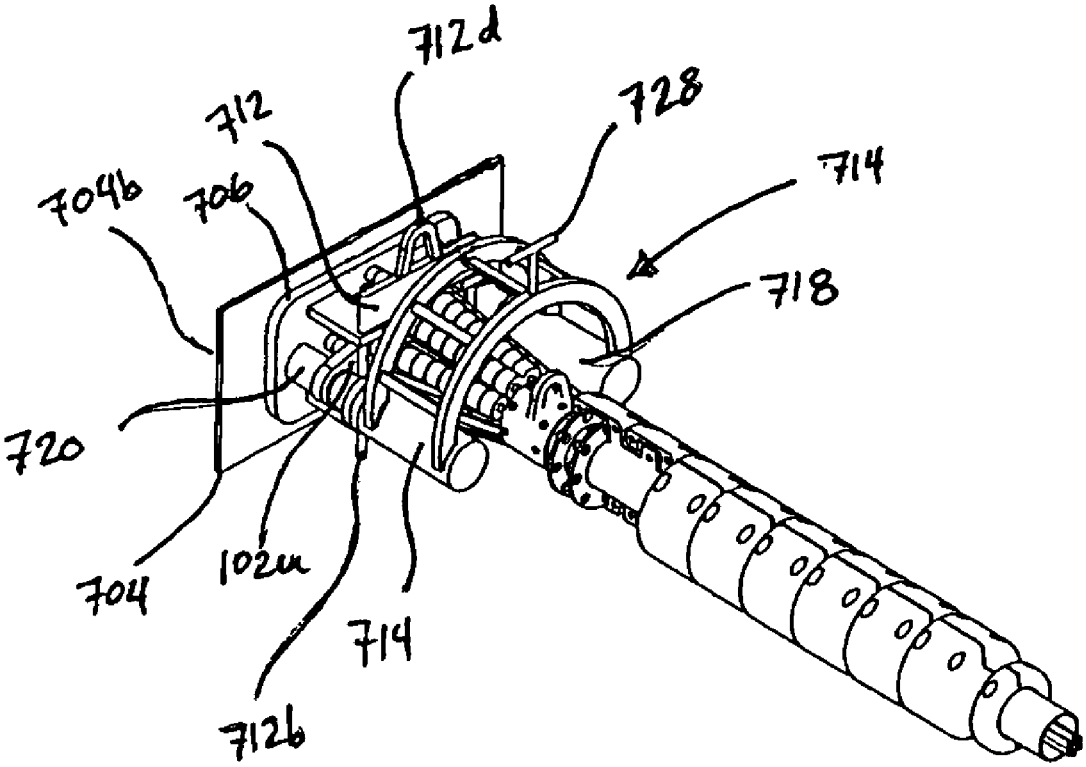
FIG. 19 is a perspective view illustrating an embodiment of the installation apparatus of FIG. 12 being used with the termination system of FIG. 1.

At step 812, as illustrated in FIG. 19, arm 712*b* on securing member 712 is situated in hole 708*aa* and arm 712*c* on securing member 712 is situated in hole 708*ba*. The securing member 712 may then be coupled to the coupling member 702 by lowering securing member 712 such that arm 712*b* travels along axis A and arm 712*c* travels along axis B until arm 712*b* is situated in hole 708*da* and arm 712*c* is situated in hole 708*ca*. In an exemplary embodiment, the securing member 712 may be lowered using handle 712*d*. With the securing member 712 coupled to coupling member 702, arms 712*b* and 712*c* engage surface 102*u* on plate 102 and secure the termination system to coupling member 702.

Figure 20:
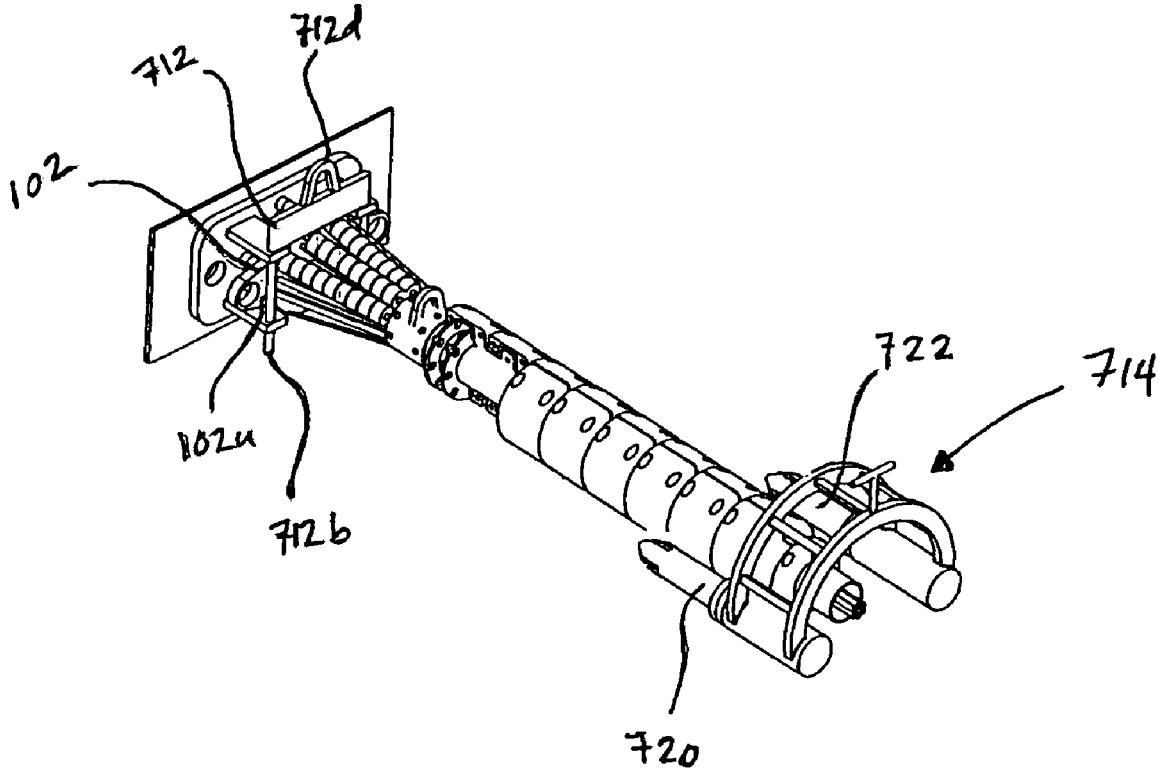
FIG. 20 is a perspective view illustrating an embodiment of the installation apparatus of FIG. 12 being used with the termination system of FIG. 1.
Figure 21:
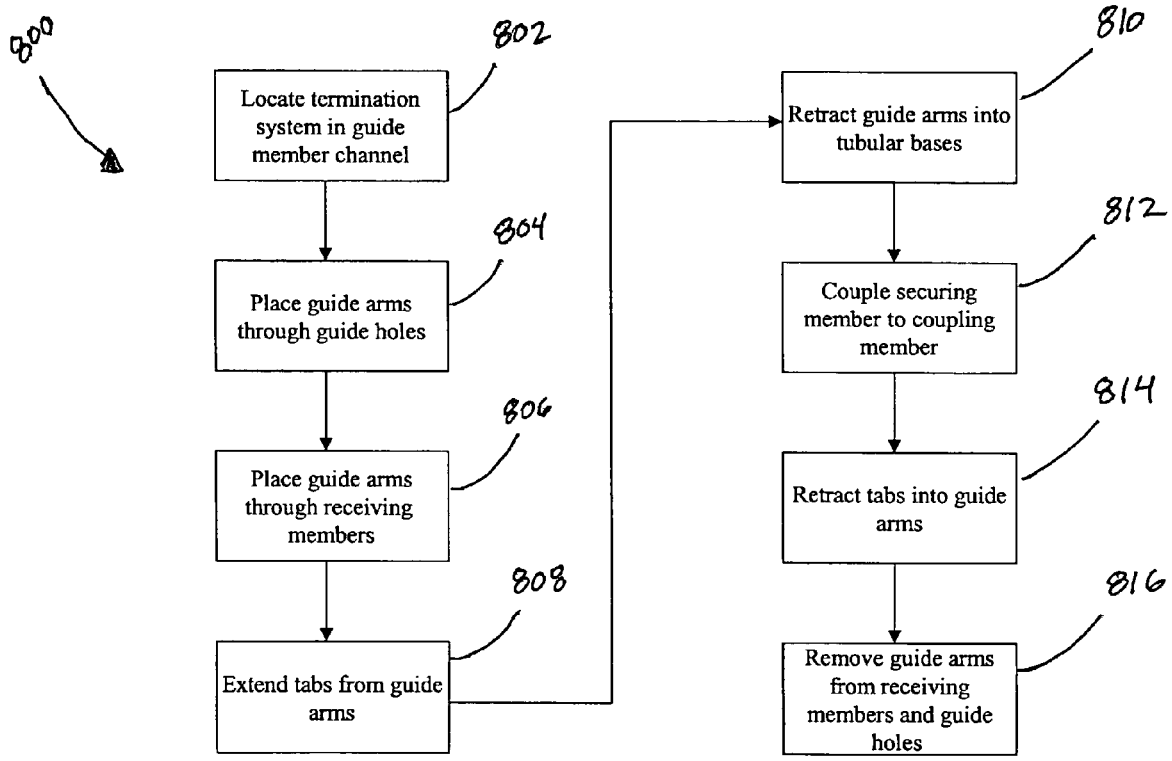
FIG. 21 is a flow chart illustrating an embodiment of a method for installing the termination system of FIG. 1 using the installation apparatus of FIG. 12.

At step 814, tabs 720*c* on guide arm 720 and tabs 722*c* on guide arm 722 may be retracted back into their respective channels 720*ca* and 722*ca* and, at step 816, as illustrated in FIG. 20, the guide arms 720 and 722 may be removed from the receiving members 706*b* and 706*c* on coupling member 702 and the guide holes 102*s* and 102*t* on plate 102. The guide member 714 may then be removed, leaving the termination system secured to the coupling member 702 by the securing member 712. In an exemplary embodiment, the plurality of tabs 720*c* and 722*c* may be hydraulically actuated and extended from or retracted into the guide arms 720 and 722 by rotating the handle in a particular direction.

Figure 22:
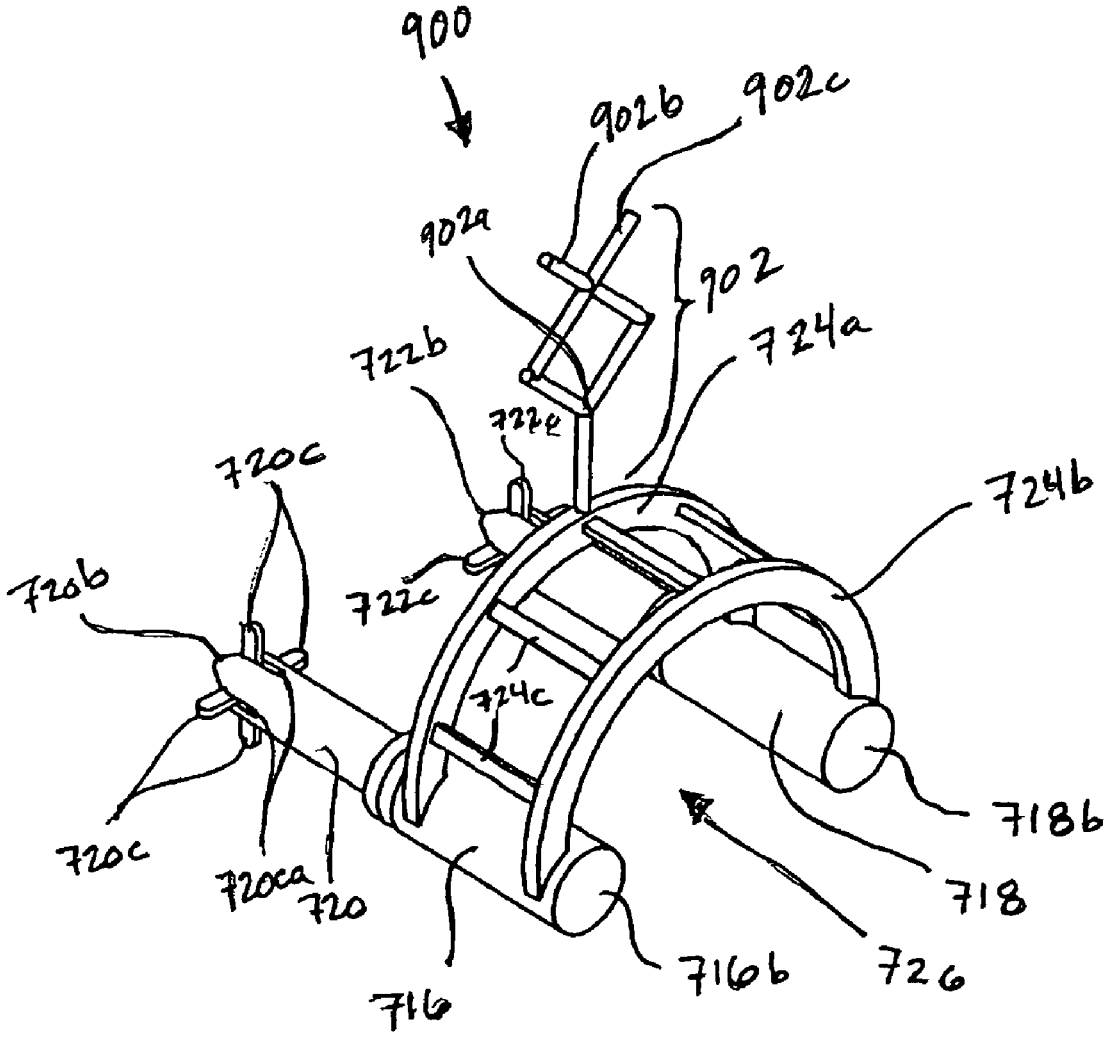
FIG. 22 is a perspective view illustrating an embodiment of a guide member used with the installation apparatus of FIG. 12.

Referring now to FIG. 22, an alternative embodiment of an installation apparatus 900 is substantially identical in design and operation to the installation apparatus 700 described above with reference to 12, 13, 14, 15*a*, 15*b*, 15*c*, 15*d*, 15*e*, 16, 17, 18, 19, 20, and 21, with the addition of a modified handle 902 on the guide member 714 including a Y-shaped member 902*a* coupled to a pair of crossed bars 902*b* and 902*c*.

Figure 23:
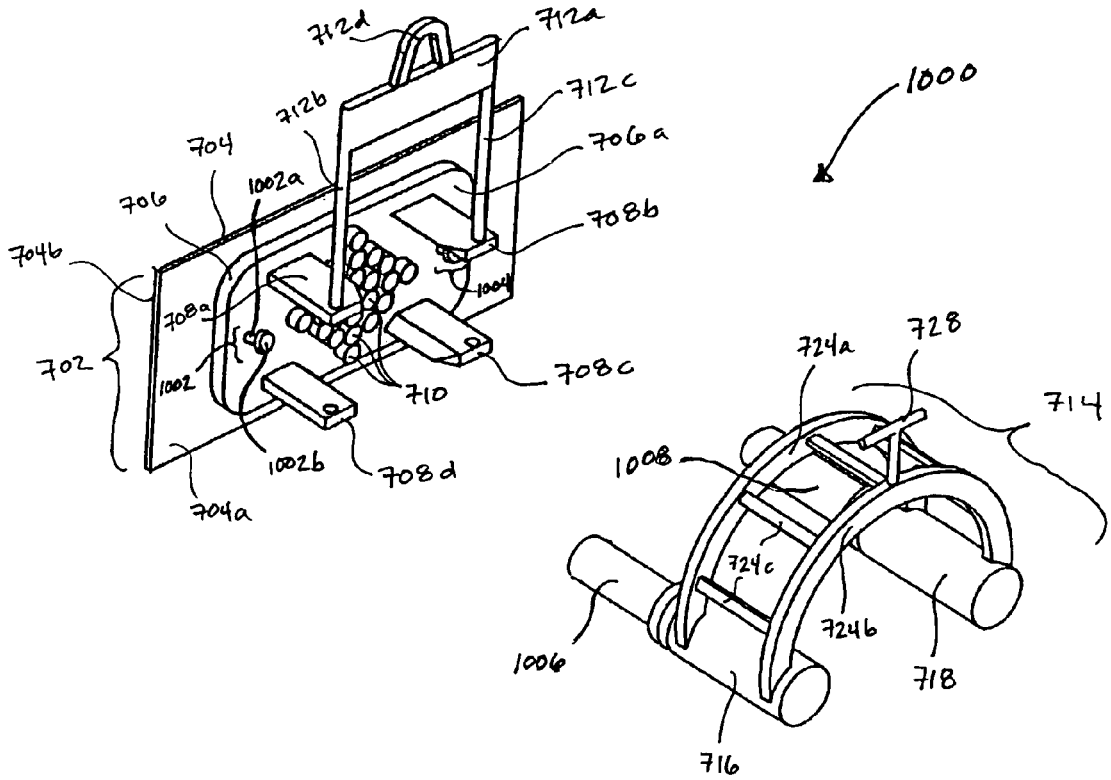
FIG. 23 is a perspective view illustrating an embodiment of an installation apparatus.
Figure 24A:
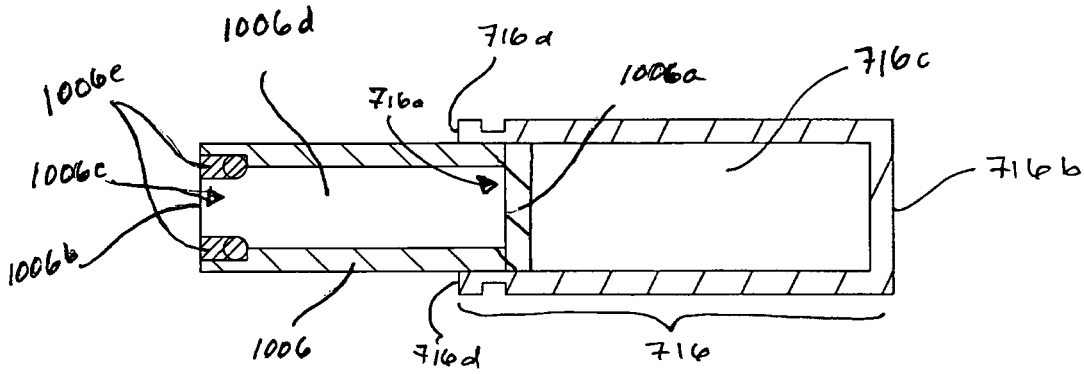
FIG. 24*a* is a cross sectional view illustrating an embodiment of a tubular base and guide arm used on the installation apparatus of FIG. 23.
Figure 24B:
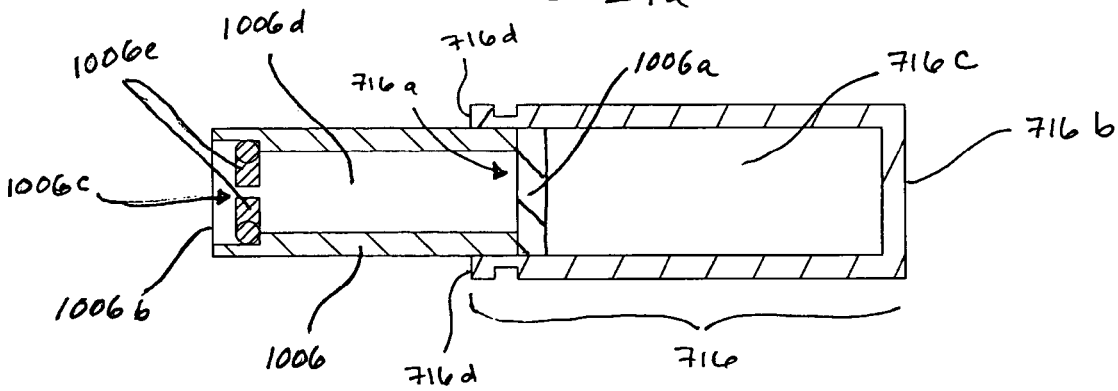
FIG. 24*b* is a cross sectional view illustrating an embodiment of a tubular base and guide arm used on the installation apparatus of FIG. 23.

Referring now to FIGS. 23, 24*a*, and 24*b*, an alternative embodiment of an installation apparatus 1000 is substantially identical in design and operation to the installation apparatus 700 described above with reference to 12, 13, 14, 15*a*, 15*b*, 15*c*, 15*d*, 15*e*, 16, 17, 18, 19, 20, and 21, with the addition of a pair of modified receiving members 1002 and 1004 on coupling member 702, and a pair of modified tubular guide arms 1006 and 1008 on the guide member 714. Modified receiving member 1002 includes a post 1002*a* extending substantially perpendicularly from the connector 706 and a securing disk 1002*b* on a distal end of the post 1002*a*. Receiving member 1004 is substantially similar to receiving member 1002. Tubular base 716 is coupled to modified tubular guide arm 1006 with a closed rear end 1006*a* and open front end 1006*b*. The rear end 1006*a* of guide arm 1006 is moveably situated in the cavity 716*c*. The front end 1006*b* provides an inlet 1006*c* to a cavity 1006*d* defined by the tubular guide arm 1006. A plurality of tabs 1006*e* are pivotally coupled to the guide arm 1006 adjacent the inlet 1006*c* and in the cavity 1006 defined by tubular guide arm 1006. Tubular base 718 is substantially similar to tubular base 716 and include a modified tubular guide arm 1008 which is substantially similar to modified tubular guide arm 1006.

Figure 25:
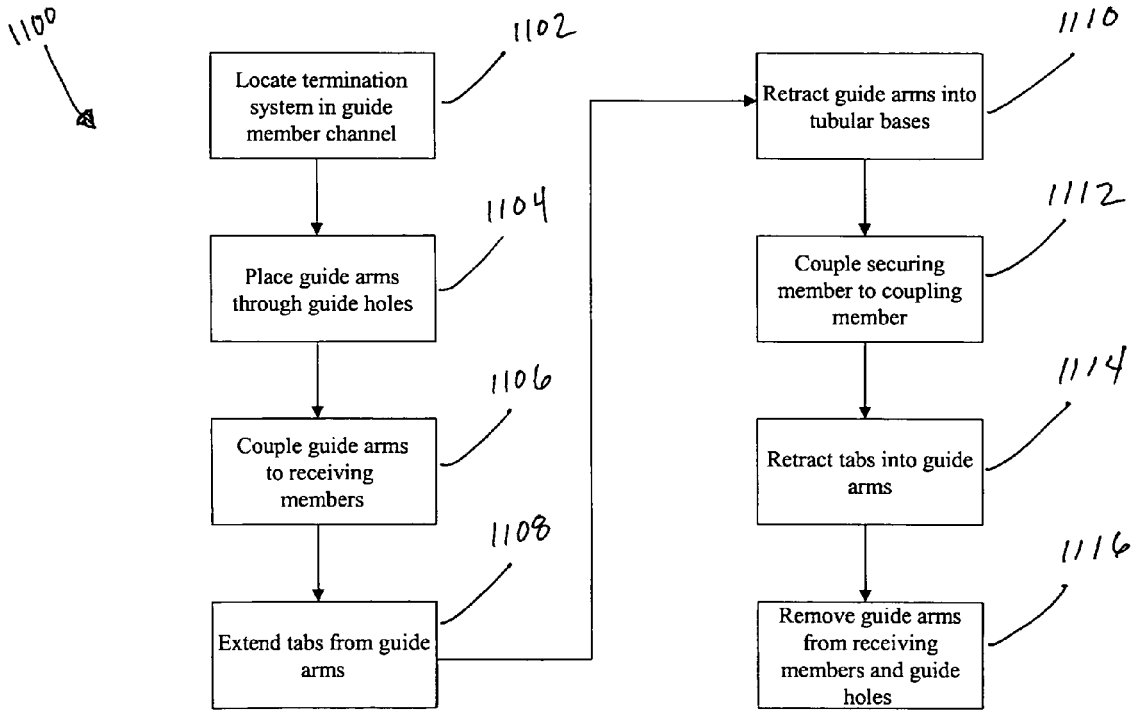
FIG. 25 is a flow chart view illustrating an embodiment of a method for installing a termination system using the installation apparatus of FIG. 23.

Referring now to FIG. 25, in an exemplary embodiment, during operation of the apparatus 1000, a method 1100 for installing a termination system is implemented which, in step 1102, the termination system, such as termination systems 100, 300, or 500 illustrated and described with reference to FIGS. 1, 2*a*, 2*b*, 3, 4, 5*a*, 5*b*, 6, 8*a*, 8*b*, 10*a*, and 10*b*, is located in the guide member channel 726 such that tubular base 716 with guide arm 1006 situated on an opposite side of the tubular lead member 118 as tubular base 718 with guide arm 1008.

With the termination system located in the guide member channel 726, at step 1104, the guide member 714 is brought towards the plate 102 such that guide arm 1006 is lined up with the guide hole 102*s* on plate 102, and guide arm 1008 is lined up with guide hole 102*t* on plate 102. The guide arms 1006 and 1008 are then placed through the guide holes 102*s* and 102*t*, respectively, such that circular lips 716*d* and 718*d* engage surface 102*u* on plate 102.

With guide arms 1006 and 1008 in respective guide holes 102*s* and 102*t*, the termination system may be manipulated by moving the guide member 714 and, at step 1106, as illustrated in FIG. 18, the guide member 714 guides the termination system towards the coupling member 702. In an exemplary embodiment, the guide member 722 may be manipulated through use of the handle 728. The guide arm 1006 is coupled to receiving member 1002 and the guide arm 1008 is coupled to receiving member 1004 by situating securing disk 1002*b* in cavity 1006*d* of guide arm 1006, and situating securing disk 1004*b* in cavity 1008*d* of guide arm 1008. Tabs 1006*e* and 1008*e* are then extended into the cavities 1006*d* and 1008*d*, respectively, such that the tab 1006*e* engages post 1002*a* and securing disk 1002*b* on receiving member 1002, and tab 1008*e* engages post 1004*a* and securing disk 1004*b* on receiving member 1004. When the guide arms 1006 and 1008 are coupled to the receiving members 1002 and 1004, the couplers, such as couplers 102*f*, 102*g*, 102*h*, 102*i*, and 102*j* on plate 102 line up with corresponding connections 710 on coupling member 702.

With the guide arms 1006 and 1008 coupled to respective receiving members 1002 and 1004, at step 1108, the tabs 1006*e* on guide arm 1006 and the tabs 1008*e* and guide arm 1008 are pivotally extended out into the cavities 1006*d* and 1008*d*. In an exemplary embodiment, the plurality of tabs 1006*e* and 1008*e* may be hydraulically actuated and extended into or retracted from the cavities 1006*d* and 1008*d* by rotating the handle 728 in a particular direction.

At step 1110, the guide arms 1006 and 1008 may be retracted into their respective cavities 716*c* and 718*c* on respective tubular bases 716 and 718 such that tabs 1006*e* and 1008*e* engage respective securing disks 1002*b* and 1004*b* on receiving members 1002 and 1004. With the tabs 1006*e* and 1008*e* engaging the receiving members 1002 and 1004, further retracting of the guide arms 1006 and 1008 into the tubular bases 716 and 718 brings plate 102 on the termination system towards coupling member 702 and mates couplers, such as couplers 102*f*, 102*g*, 102*h*, 102*i*, and 102*j*, with their corresponding connections 710. In an exemplary embodiment, the guide arms 1006 and 1008 may be actuated and extended from or retracted into the cavities 716*c* and 718*c* by rotating the handle 728 in a predetermined direction.

At step 1112, arm 712*b* on securing member 712 is situated in hole 708*aa* and arm 712*c* on securing member 712 is situated in hole 708*ba*. The securing member 712 may then be coupled to the coupling member 702 by lowering securing member 712 such that arm 712*b* travels along axis A and arm 712*c* travels along axis B until arm 712*b* is situated in hole 708*da* and arm 712*c* is situated in hole 708*ca*. In an exemplary embodiment, the securing member 712 may be lowered using handle 712*d*. With the securing member 712 coupled to coupling member 702, arms 712*b* and 712*c* engage surface 102*u* on plate 102 and secure the termination system to coupling member 702.

At step 1114, tabs 1006*e* on guide arm 1006 and tabs 1008*e* on guide arm 1008 may be retracted back from their respective cavities 1006*d* and 1008*d* and, at step 1116, the guide arms 1006 and 1008 may be removed from the receiving members 1002 and 1004 on coupling member 702 and the guide holes 102*s* and 102*t* on plate 102. The guide member 714 may then be removed, leaving the termination system secured to the coupling member 702 by the securing member 712. In an exemplary embodiment, the plurality of tabs 1006*e* and 1008*e* may be hydraulically actuated and extended from or retracted into the guide arms 1006 and 1008 by rotating the handle in a particular direction.

An installation apparatus has been described that includes a guide member defining a channel, at least one base coupled to the guide member, a guide arm moveably coupled to the at least one base, and an engagement member coupled to the guide arm. In an exemplary embodiment, the channel is semicircular. In an exemplary embodiment, a pair of bases are situated on opposite sides of the channel. In an exemplary embodiment, the guide arm is operable to extend from and retract to the at least one base. In an exemplary embodiment, the engagement member is pivotally coupled to the guide arm. In an exemplary embodiment, a handle is provided on the guide member which is operable to manipulate the guide member. In an exemplary embodiment, the guide member is situated beneath a body of water.

An installation apparatus has been described that includes a coupling member comprising at least one connector, at least one receiving member coupled to the coupling member, at least one securing support coupled to the coupling member, and a securing member operable to couple to the coupling member. In an exemplary embodiment, the at least one receiving member comprises at least one hole defined by the coupling member. In an exemplary embodiment, the at least one receiving member extends from a surface of the coupling member adjacent the at least one connector. In an exemplary embodiment, the at least one securing support defines at least one hole operable to couple the securing member to the coupling member. In an exemplary embodiment, the securing member comprises at least one arm operable to couple the securing member to the coupling member. In an exemplary embodiment, the securing member comprises a handle operable to manipulate the securing member. In an exemplary embodiment, the coupling member and securing member are situated beneath a body of water. In an exemplary embodiment, a termination system is coupled to the at least one connector and secured to the coupling system by the securing member. In an exemplary embodiment, an off shore structure is coupled to the termination system.

A installation apparatus has been described that includes a coupling member comprising at least one receiving member, a guide member comprising at least one guide arm, the at least one guide arm operable to be received by the at least one receiving member, and at least one securing member operable to couple to the coupling member and secure a device to the coupling member. In an exemplary embodiment, the at least one receiving member comprises at least one hole defined by the coupling member. In an exemplary embodiment, the at least one guide arm comprises at least one engagement member. In an exemplary embodiment, the at least one engagement member is retractable to the at least one guide arm. In an exemplary embodiment, the at least one guide arm is retractable to the guide member. In an exemplary embodiment, the coupling member comprises at least one securing support, the at least one securing support operable to couple the securing member to the coupling member. In an exemplary embodiment, at least one of the group consisting of the coupling member, the guide member, the securing member, and a combination thereof are situated beneath a body of water.

A method for installing an undersea umbilical has been described that includes providing a terminating end on the umbilical, providing a connector operable to couple to the terminating end, guiding the terminating end to the connector, aligning the terminating end to connect to the connector, connecting the terminating end to the connector, and securing the terminating end to the connector. In an exemplary embodiment, the guiding comprises providing a guide member, coupling the guide member to the terminating end, and moving the guide member. In an exemplary embodiment, the aligning comprises providing a guide member comprising a guide arm, providing a receiving member adjacent the connector, coupling the guide arm to the terminating end, and locating the guide arm in the receiving member. In an exemplary embodiment, the connecting comprises providing a guide member comprising a guide arm, providing a receiving member adjacent the connector, coupling the guide arm to the terminating end, locating the guide arm to the receiving member, coupling the guide arm to the receiving member, and retracting the guide arm to engage the terminating end and the connector. In an exemplary embodiment, the securing comprises providing a securing support adjacent the connector, providing a securing member, and coupling the securing member to the securing support, whereby with the securing member coupled to the securing support, the securing member abuts the terminating end. In an exemplary embodiment, the method includes situating the umbilical and connector beneath a body of water. In an exemplary embodiment, the method includes providing an offshore structure coupled to the umbilical.

An undersea umbilical has been described that includes a terminating end coupled to the umbilical, a coupling member comprising at least one receiving member and at least one connector, the at least one connector coupled with the terminating end, at least one securing support coupled to the coupling member, and a securing member coupled to the coupling member and securing the terminating end to the at least one connector. In an exemplary embodiment, the terminating end comprises a plate defining at least one guide hole, the at least one guide hole operable to line up with the at least one receiving member. In an exemplary embodiment, an off shore structure is coupled to the umbilical. In an exemplary embodiment, the at least one receiving member comprises at least one hole defined by the coupling member. In an exemplary embodiment, the at least one securing support extends from a surface of the coupling member adjacent the at least one connector. In an exemplary embodiment, the at least one securing support defines at least one hole operable to couple the securing member to the coupling member. In an exemplary embodiment, the securing member comprises at least one arm operable to couple the securing member to the coupling member. In an exemplary embodiment, the securing member comprises a handle operable to manipulate the securing member. In an exemplary embodiment, the umbilical is situated beneath a body of water.

An apparatus has been described that includes an off shore structure, an umbilical coupled to the structure, the umbilical comprising a terminating end, a coupling member comprising at least one receiving member and at least one connector, the at least one connector coupled with the terminating end, at least one securing support coupled to the coupling member, and a securing member coupled to the coupling member and securing the terminating end to the at least one connector. In an exemplary embodiment, the terminating end comprises a plate defining at least one guide hole, the at least one guide hole operable to line up with the at least one receiving member. In an exemplary embodiment, the at least one receiving member comprises at least one hole defined by the coupling member. In an exemplary embodiment, the at least one securing support extends from a surface of the coupling member adjacent the at least one connector. In an exemplary embodiment, the at least one securing support defines at least one hole operable to couple the securing member to the coupling member. In an exemplary embodiment, the securing member comprises at least one arm operable to couple the securing member to the coupling member. In an exemplary embodiment, the securing member comprises a handle operable to manipulate the securing member. In an exemplary embodiment, the structure is situated on top of a body of water. In an exemplary embodiment, the umbilical is situated beneath a body of water. In an exemplary embodiment, the coupling member is situated beneath a body of water.

An installation apparatus has been described that includes means for receiving a terminating end of the umbilical, means for guiding the terminating end of the umbilical, the means for guiding operable to be received by the means for receiving, and means for securing the terminating end of the umbilical to the means for receiving. In an exemplary embodiment, the means for guiding comprises a means for manipulating the means for guiding. In an exemplary embodiment, the means for guiding comprises a means for engaging the means for receiving. In an exemplary embodiment, the means for engaging the mean for receiving comprises a means for retracting the means for engaging to the means for guiding. In an exemplary embodiment, the means for guiding comprises a member comprising a means for retracting the member in the means for guiding. In an exemplary embodiment, the means for receiving comprises a means for supporting the means for securing.

An installation apparatus has been described that includes a coupling member defining a plurality of receiving holes, a guide member comprising a plurality of guide arms, the plurality of guide arms operable to be received by the plurality of receiving holes, an actuator coupled to the guide member, the actuator operable to retract the plurality of guide arms to the guide member, a plurality of engagement members on each guide arm, the engagement members operable to retract to the guide arm, a handle coupled to the guide member, the handle operable to manipulate the guide member, a securing member operable to couple to the coupling member and secure a device to the coupling member, and a plurality of securing supports coupled to the coupling member, the plurality of securing supports operable to couple the securing member to the coupling member. In an exemplary embodiment, the apparatus is situated beneath a body of water.

An installation apparatus has been described that includes a guide member defining a semi-circular channel, a pair of bases coupled to the guide member, the bases situated on opposite sides of the channel, a pair of guide arm moveably coupled to the pair of bases, the guide arms operable to extend from and retract to their respective bases, a plurality of engagement members pivotally coupled to each guide arm, and a handle coupled to the guide member operable to manipulate the guide member. In an exemplary embodiment, the apparatus is situated beneath a body of water.

An installation apparatus has been described that includes a coupling member comprising a plurality of connectors, a plurality of receiving holes defined by the coupling member and situated adjacent the plurality of connectors, a plurality of securing supports extending from a surface of the coupling member and adjacent the plurality of connectors, a securing hole defined by each securing support, a securing member comprising a plurality of arms, the plurality of arms operable to couple the securing member to the coupling member by situating the plurality of arms in the securing holes defined by the plurality of securing supports, and a handle coupled to the securing member operable to manipulate the securing member. In an exemplary embodiment, the apparatus is situated beneath a body of water.

An undersea umbilical has been described that includes a terminating end coupled to the umbilical, the terminating end comprising a plate defining a plurality of guide holes, a coupling member comprising a plurality of connectors coupled to the terminating end, a plurality of receiving holes defined by the coupling member, the plurality of receiving holes operable to line up with the plurality of guide holes, a plurality of securing supports extending from a surface of the coupling member and adjacent the plurality of connectors, a securing hole defined by each securing member, a securing member comprising a plurality of arms, the plurality of arms securing the terminating end to the connectors by situating the plurality of arms in the securing holes defined by the plurality of securing supports, and a handle coupled to the securing member operable to manipulate the securing member. In an exemplary embodiment, the terminating end secured to the connectors is situated beneath a body of water.

A method for installing an undersea umbilical has been described that includes providing a terminating end on the umbilical, providing a connector operable to couple to the terminating end, guiding the terminating end to the connector, whereby the guiding comprises providing a guide member, coupling the guide member to the terminating end, and moving the guide member; aligning the terminating end to connect to the connector, whereby the aligning comprises providing a guide member comprising a guide arm, providing a receiving member adjacent the connector, coupling the guide arm to the terminating end, and locating the guide arm in the receiving member; connecting the terminating end to the connector, whereby the connecting comprises providing a guide member comprising a guide arm, providing a receiving member adjacent the connector, coupling the guide arm to the terminating end, locating the guide arm to the receiving member, coupling the guide arm to the receiving member, and retracting the guide arm to engage the terminating end and the connector; and securing the terminating end to the connector, whereby the securing comprises providing a securing support adjacent the connector, providing a securing member, and coupling the securing member to the securing support, whereby with the securing member coupled to the securing support, the securing member abuts the terminating end. In an exemplary embodiment, the method includes situating the umbilical at least partially beneath a body of water.

A installation apparatus for an undersea umbilical has been described that includes means for receiving a terminating end of the umbilical, means for guiding the terminating end of the umbilical, the means for guiding operable to be received by the means for receiving, means for manipulating the means for guiding coupled to the means for guiding, means for engaging the means for receiving coupled to the means for guiding, means for retracting the means for engaging to the means for guiding coupled to the means for engaging, means for securing the terminating end of the umbilical to the means for receiving, and means for supporting the means for securing coupled to the means for receiving. In an exemplary embodiment, the apparatus is situated beneath a body of water.

It is understood that variations may be made in the foregoing without departing from the scope of the disclosed embodiments. Furthermore, the elements and teachings of the various illustrative embodiments may be combined in whole or in part some or all of the illustrated embodiments.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A subsea umbilical installation apparatus comprising:

a coupling member affixed to a piece of subsea equipment, the coupling member operatively connected to the subsea umbilical, the coupling member comprising a plurality of connectors;

a plurality of receiving holes defined by the coupling member and situated adjacent the plurality of connectors;

a plurality of securing supports extending from a surface of the coupling member and adjacent the plurality of connectors; a securing hole defined by each securing support;

a securing member comprising a plurality of arms to straddle at least a portion of the subsea umbilical, the plurality of arms operable to couple the securing member to the coupling member by situating the plurality of arms in the securing holes defined by the plurality of securing supports; and a handle coupled to the securing member operable to manipulate the securing member.

2. The apparatus of claim 1 wherein the apparatus is situated beneath a body of water.

* * * * *